US007138994B2

(12) United States Patent
Cho et al.

(10) Patent No.: US 7,138,994 B2
(45) Date of Patent: Nov. 21, 2006

(54) ENERGY RECOVERING CIRCUIT WITH BOOSTING VOLTAGE-UP AND ENERGY EFFICIENT METHOD USING THE SAME

(75) Inventors: Jang-Hwan Cho, Kumi-shi (KR); Nam-Kyu Lee, Kumi-shi (KR); Cheul-U Kim, Pusan (KR); Feel-Soon Kang, Pusan (KR); Eung-Kwan Lee, Daegu (KR); Jae-Hwa Ryu, Kumi-shi (KR); Sung-Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 10/416,286

(22) PCT Filed: Nov. 9, 2001

(86) PCT No.: PCT/KR01/01915

§ 371 (c)(1),
(2), (4) Date: May 9, 2003

(87) PCT Pub. No.: WO02/39419

PCT Pub. Date: May 16, 2002

(65) Prior Publication Data

US 2004/0036686 A1 Feb. 26, 2004

(30) Foreign Application Priority Data

Nov. 9, 2000 (KR) ..... 10-2000-0066327
Nov. 8, 2001 (KR) ..... 10-2001-0069588

(51) Int. Cl.
*G09G 3/28* (2006.01)
*G09G 5/00* (2006.01)

(52) U.S. Cl. ..... 345/211; 345/160; 345/690

(58) Field of Classification Search ..... 345/211, 345/60–68

See application file for complete search history.

(56) References Cited

U.S. PATENT DOCUMENTS 3,559,190 A 1/1971 Bitzer et al.

(Continued)

FOREIGN PATENT DOCUMENTS

EP 0 044 182 A2 1/1982

(Continued)

OTHER PUBLICATIONS

Criscimagna, "Low Voltage Circuits for Plasma Display Panel," SID-Soceity for Information Display, Proceedings, vol. 17, No. 3, 1976, pp. 124-129.

(Continued)

*Primary Examiner*—Richard Hjerpe
*Assistant Examiner*—Duc Dinh
(74) *Attorney, Agent, or Firm*—Fleshner & Kim, LLP

(57) ABSTRACT

There is disclosed an energy recovering circuit with boosting voltage-up and an energy efficient method using the same that are capable of boosting the voltage factor of an energy recovered from the panel to rapidly re-appl it to the panel, to thereby reduce the charging time of a panel capacitor and improve its energy recovery efficiency. An energy recovering circuit according to the present invention includes a voltage boosting circuit for boosting a voltage factor of an energy recovered from a panel and supplying the boosted energy to the panel. An energy efficient method according to the present invention includes steps of recovering an energy from a panel to a closed loop; and a controlling the closed loop in order to supplying the energy with its voltage factor boosted to the panel.

23 Claims, 21 Drawing Sheets

U.S. PATENT DOCUMENTS

| | | | | |
|---|---|---|---|---|
| 3,626,224 | A | 12/1971 | Holz | |
| 3,780,339 | A | 12/1973 | Mayle | |
| 4,070,663 | A | 1/1978 | Kanatani et al. | |
| 4,268,898 | A | 5/1981 | Brown | |
| 4,303,918 | A | 12/1981 | Reagan et al. | |
| 4,316,123 | A | 2/1982 | Kleen et al. | |
| 4,347,509 | A | 8/1982 | Hardway et al. | |
| 4,496,879 | A | 1/1985 | Suste | |
| 4,550,274 | A | 10/1985 | Weber | |
| 4,570,159 | A | 2/1986 | Criscimagna et al. | |
| 4,707,692 | A | 11/1987 | Higgins et al. | 340/805 |
| 4,772,884 | A | 9/1988 | Weber et al. | |
| 4,866,349 | A | 9/1989 | Weber et al. | 315/169.4 |
| 4,924,218 | A | 5/1990 | Weber et al. | |
| 5,081,400 | A | 1/1992 | Weber et al. | 315/169.4 |
| 5,107,182 | A | 4/1992 | Sano et al. | |
| 5,126,727 | A | 6/1992 | Asars | |
| 5,227,696 | A | 7/1993 | Asars | |
| 5,438,290 | A | 8/1995 | Tanaka | |
| 5,528,256 | A | 6/1996 | Erhart et al. | |
| 5,535,085 | A | 7/1996 | Tanaka et al. | |
| 5,559,402 | A | 9/1996 | Corrigan, III | |
| 5,670,974 | A | 9/1997 | Ohba et al. | 345/60 |
| 6,175,192 | B1 * | 1/2001 | Moon | 315/169.3 |
| 6,400,343 | B1 * | 6/2002 | Zorzan et al. | 345/60 |

FOREIGN PATENT DOCUMENTS

| | | |
|---|---|---|
| EP | 0 071 260 A2 | 2/1983 |
| EP | 0 078 648 A2 | 5/1983 |
| JP | 51-71730 | 6/1976 |
| JP | 51-115734 | 10/1976 |
| JP | 58-53344 | 11/1983 |
| JP | 59-137992 | 8/1984 |
| JP | 51-77027 | 7/1993 |
| JP | 05-265396 | 10/1993 |
| JP | 07-160215 | 6/1995 |
| JP | 11-161226 | 6/1999 |
| TW | 346621 | 12/1998 |

OTHER PUBLICATIONS

SID-Soceity for Information Display, International Symposium Conference Record, pp. 220-223, May 1986, San Diego.

Higgins, M.L., "A Low Power Drive Scheme For AC TFEL Displays," SID-Soceity for Information Display, International Symposium Digest of Technical Papers, vol. 16, 1985, pp. 226-228, Los Angeles.

Higgins, M.L., "High-Quality Electroluminescent Display For A Personal Workstation," Hewlett-Packard Journal, vol. 36, No. 10, pp. 12-17, Oct. 1985, Palo Atlo, CA.

Ohwaki, Kenichi, "Plasma Display," Extract from Textbook published Nov. 15, 1983—Currently unavailable.*

* cited by examiner

ENERGY RECOVERING CIRCUIT WITH BOOSTING VOLTAGE-UP AND ENERGY EFFICIENT METHOD USING THE SAME

TECHNICAL FIELD

This invention relates to an energy recovering apparatus for a plasma display panel, and more particularly to an energy recovering circuit with boosting voltage-up and an energy efficient method using the same that are capable of boosting the voltage factor of an energy recovered from the panel to rapidly re-apply it to the panel, to thereby reduce the charging time of a panel capacitor and improve its energy recovery efficiency.

Also, this invention relates to an energy recovering circuit and an energy efficient method using the same that are capable of reducing the number of necessary devices.

BACKGROUND ART

Generally, a plasma display panel (PDP) has a disadvantage of large power consumption. A reduction of such power consumption requires enhancing a light-emitting efficiency and minimizing an unnecessary energy waste occurring in a driving process without a direct relation to a discharge.

An alternating current (AC)-type PDP coats an electrode with a dielectric material to use a surface discharge occurring at the surface of the dielectric material. In this AC-type PDP, a driving pulse has a high voltage of dozens to hundreds of volts (V) to make a sustaining discharge of tens of thousand to millions of cells, and has a frequency of more than hundreds of KHz. If such a driving pulse is applied to the cells, a charge/discharge having a high capacitance occurs.

When such a charge/discharge is generated at the PDP, a capacitive load of the panel does not cause an energy waste, but a lot of energy loss occurs at the PDP because a direct current (DC) power source is used to generate a driving pulse. Particularly, if an excessive current flows in the cell upon discharge, then an energy loss is increased. This energy loss causes a temperature rise of switching devices, which may break the switching devices in the worst case. In order to recover an energy generated unnecessarily within the panel, a driving circuit of the PDP includes an energy recovering circuit.

Referring to FIG. 1, an energy recovering circuit having been suggested by U.S. Pat. No. 5,081,400 of Weber includes first and second switches Sw1 and Sw2 connected, in parallel, between an inductor L and a capacitor Css, a third switch Sw3 for applying a sustaining voltage Vs to a panel capacitor Cp, and a fourth switch Sw4 for applying a ground voltage GND to the panel capacitor Cp.

First and second diodes D1 and D2 for limiting a reverse current are connected between the first and second switches Sw1 and Sw2. The panel capacitor Cp is an equivalent expression of a capacitance value of the panel, and reference numerals Re and R-Cp are equivalent expressions of parasitic resistances of an electrode and a cell provided at the panel, respectively. Each of the switches Sw1, Sw2, Sw3 and Sw4 is implemented by a semiconductor switching device, for example, a MOS FET device.

An operation of the energy recovering circuit shown in FIG. 1 will be described in conjunction with FIG. 2 assuming that a voltage equal to Vs/2 should be charged in the capacitor Css.

In FIG. 2, Vcp and Icp represent charge/discharge voltage and current of the panel capacitor Cp, respectively.

At a time t1, the first switch Sw1 is turned on. Then, a voltage stored in the capacitor Css is applied, via the first switch Sw1 and the first diode D1, to the inductor L. Since the inductor L constructs a serial LC resonance circuit along with the panel capacitor Cp, the panel capacitor Cp begins to be charged in a resonant waveform.

At a time t2, the first switch Sw1 is turned off while the third switch Sw3 is turned on. Then, a sustaining voltage Vs is applied, via the third switch Sw3, to the panel capacitor Cp. From the time t2 until a time t3, a voltage of the panel capacitor Cp remains at a sustaining level.

At a time t3, the third switch Sw3 is turned off while the second switch Sw2 is turned on. Then, a voltage of the panel capacitor Cp is recovered into the capacitor Css by way of the inductor L, the second diode D2 and the second switch Sw2.

At a time t4, the second switch Sw2 is turned off while the fourth switch Sw4 is turned on. Then, a voltage of the panel capacitor Cp drops into a ground voltage GND.

In the energy recovering circuit, there are requirements for improving the discharge characteristics of the panel, obtaining stable sustaining time, and increasing the efficiency of the energy recovered from the panel. For this, the conventional energy recovering circuit of FIG. 1 makes the inductance of the inductor L small to have it fast a rising time supplied to the panel. Thereby, the discharge characteristics can be increased and the inductance of the inductor L is made big such that the energy recovering efficiency can be improved.

However, because the conventional energy recovering circuit as in FIG. 1 uses the same inductor L on the charge/discharge path, if the rising time is made to be fast by setting the inductance of the inductor L to be small, the energy recovering efficiency decreases as it peak current becomes big. On the contrary, in the conventional energy recovering circuit, if the energy recovering efficiency is improved by setting the inductance of the inductor L to be big, because the rising time of the voltage supplied to the panel is lengthened, the discharge characteristics is deteriorated and it becomes difficult to obtain the sustaining time.

Also, because the conventional energy recovering circuit requires many semiconductor switching devices Sw1 to Sw4, an inductor L and a recovering capacitor for the operation of recovery, charge and sustaining steps, its manufacturing cost is high.

DISCLOSURE OF INVENTION

Accordingly, it is an object of the present invention to provide an energy recovering circuit and an energy efficient method using the same that are capable of reducing the charging time of a panel and improving its energy recovery efficiency.

A further object of the present invention is to provide an energy recovering circuit and an energy efficient method using the same that are capable of reducing the number of necessary switching devices.

In order to achieve these and other objects of the invention, an energy recovering circuit according to one aspect of the present invention includes a voltage boosting circuit for boosting a voltage factor of an energy recovered from a panel and supplying the boosted energy to the panel.

The energy recovering circuit further includes a switching device for switching a signal path between the voltage boosting circuit and the panel.

In the energy recovering circuit, the voltage boosting circuit includes a capacitor for accumulating the energy recovered from the panel; an inductor for accumulating an electric current factor of the energy from the capacitor; and a switching device for switching a signal path between the capacitor and the inductor.

In the energy recovering circuit, the capacitor, the inductor and the switching device are connected to form a closed loop.

In the energy recovering circuit, the closed loop is formed to be separate from the panel.

In the energy recovering circuit, a voltage factor of the energy recovered from the panel is boosted by a reverse voltage induced in the inductor through the switching of the switching device.

In the energy recovering circuit, the closed loop is formed for accumulating an electric current at the inductor.

In the energy recovering circuit, the closed loop is opened for boosting the voltage factor of the energy.

In the energy recovering circuit, the closed loop is opened to supply the energy accumulated at the capacitor with the voltage factor boosted to the panel.

In the energy recovering circuit, the switching device makes the voltage boosting circuit supply the energy including the boosted voltage factor to the panel and recover the energy from the panel.

The energy recovering circuit further includes a sustaining voltage source for generating a sustaining voltage; and a second switching device for supplying the sustaining voltage from the sustaining voltage source to the panel.

In the energy recovering circuit, the signal path keeps its signal progress direction at one direction while the energy with the boosted voltage factor is supplied to the panel and while the energy from the panel is recovered to the voltage boosting circuit.

In the energy recovering circuit, the signal path has its signal progress direction changed in accordance with whether the energy with the boosted voltage factor is supplied to the panel or whether the energy from the panel is recovered to the voltage boosting circuit.

In the energy recovering circuit, the signal path includes a bridge diode.

The energy recovering circuit further includes a second switching device mounted between the inductor and the switching device for sustaining its turn-on state while a voltage of the panel remains at a ground voltage level and being alternately turned on and off during the other intervals.

In the energy recovering circuit, the switching device is a transistor with a body diode built-in.

The energy recovering circuit further includes a ground voltage source for supplying a ground voltage to the panel; and a second switching device for supplying the ground voltage from the ground voltage source to the panel.

In the energy recovering circuit, the voltage boosting circuit further includes at least one other inductor with an inductance different from that of the inductor, connected in parallel to the inductor.

The energy recovering circuit further includes a first diode having a cathode connected to the inductor with a small inductance value among the inductors, and an anode connected to the capacitor; and a second diode having a cathode connected to the inductor with a big inductance value among the inductors, and an anode connected to the switching device.

The energy recovering circuit further includes a diode having a cathode connected to the panel and an anode connected to the voltage boosting circuit.

The energy recovering circuit further includes a diode having a cathode connected to the sustaining voltage source and an anode connected to a connection point of the voltage boosting circuit and the first switching device.

The energy recovering circuit further includes a diode having a cathode connected to the voltage boosting circuit and the first switching device, and an anode connected to the ground voltage ground.

The energy recovering circuit further includes a third switching device for supplying the sustaining voltage to the panel in a ramp voltage type with a gradient of a predetermined time constant.

An energy recovering circuit of a plasma display panel according to another aspect of the present invention includes, wherein a first energy signal is inputted from a panel and a second energy signal bigger than the first energy signal is supplied to the panel.

An energy efficient method according to still another aspect of the present invention includes steps of recovering an energy from a panel to a closed loop; and controlling the closed loop in order to supplying the energy with its voltage factor boosted to the panel.

The energy efficient method further includes a step of making the closed loop electrically insulated from the panel after recovering the energy from the panel to the closed loop.

In the energy efficient method, the step of controlling the closed loop includes a step of inducing a reverse voltage.

In the energy efficient method, the step of inducing the reverse voltage includes a step of accumulating an electric current.

In the energy efficient method, the closed loop is opened.

The energy efficient method further includes a step of supplying a sustaining voltage to the panel.

The energy efficient method further includes a step of supplying a ground voltage to the panel.

The energy efficient method further includes a step of supplying a sustaining voltage in a type of a ramp voltage with a required gradient to the panel.

An energy efficient method according to still another aspect of the present invention includes steps of recovering an energy from a panel; boosting a voltage factor of the recovered energy; and supplying the energy with its voltage factor boosted to the panel.

In the energy efficient method, the step of boosting the voltage factor utilizes a closed loop.

In the energy efficient method further includes a step of making the closed loop electrically insulated from the panel after recovering the energy from the panel to the closed loop.

In the energy efficient method, the step of boosting the voltage factor includes steps of circulating to accumulate an electric current factor included in the recovered energy; and supplying the accumulated electric current factor together with the recovered energy in a type of the voltage factor to the panel.

BRIEF DESCRIPTION OF DRAWINGS

These and other objects of the invention will be apparent from the following detailed description of the embodiments of the present invention with reference to the accompanying drawings, in which.

BEST MODE FOR CARRYING OUT THE INVENTION

With reference to FIGS. 3 to 30, there are particularly explained embodiments of the present invention, as follows.

Figure 3:
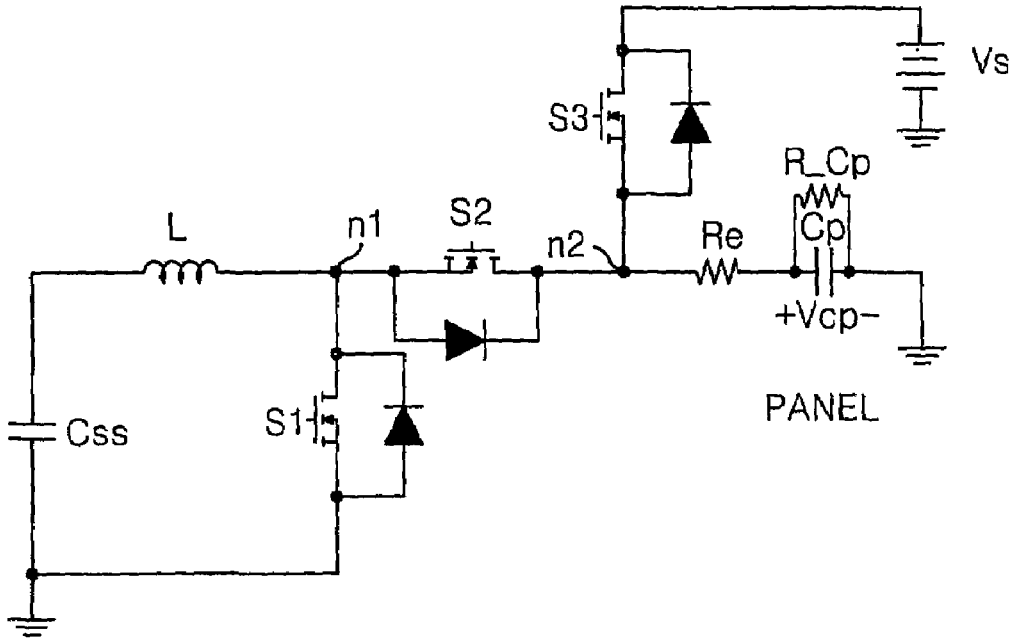
FIG. 3 is a circuit diagram of a energy recovering circuit according to a first embodiment of the present invention.

Referring to FIG. 3, an energy recovering circuit according to a first embodiment of the present invention includes an capacitor Css, an inductor L and a first switch S1 connected to form a closed loop; a second switch S2 connected, via a second node n2, to a panel capacitor Cp; and a third switch S3 connected between a second node n2 and a sustaining voltage source vs.

The panel capacitor Cp represents a capacitance value of the panel, and reference numerals Re and R-Cp represent parasitic resistances of an electrode and a cell provided at the panel, respectively. Each of the switches S1, S2 and S3 is implemented by a semiconductor switching device, for example, MOS FET, IGBT, SCR, BJT and etc.

While the first switch S1 is turned on, there is formed a closed loop of electric current which starts from the terminal of one side of the capacitor Css and is connected to the terminal of another side of the capacitor Css, via the inductor L and the first switch S1. Electric current is accumulated at the inductor L in the closed loop by the electric charge discharged from the capacitor Css. After the first switch S1 is turned off, the electric current of the inductor L becomes maximized, and at the same time, a reverse voltage is induced across the inductor L. Thus, in a first node n1 appears a boosted voltage that is made by adding the voltage of the capacitor Css and the reverse voltage induced at the inductor L.

The second switch S2 applies the boosted voltage from the first node n1 to the panel capacitor Cp and applies a voltage factor of an energy recovered from the panel capacitor Cp to the capacitor Css, via the inductor L. The third switch S3 applies a sustaining voltage Vs to the panel capacitor Cp so as to keep a voltage of the panel capacitor Cp at a sustaining voltage level.

Figure 4:
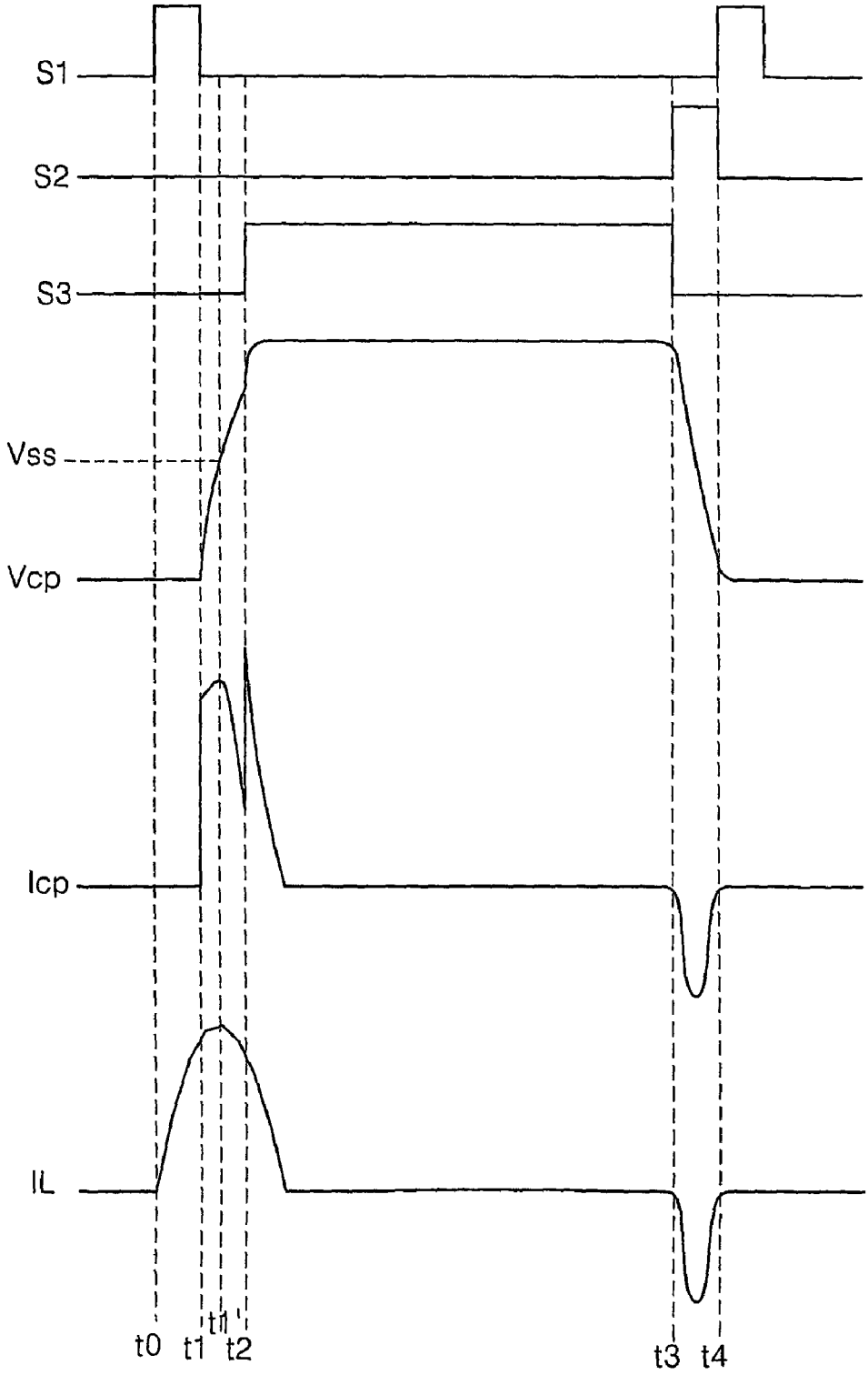
FIG. 4 is a driving waveform diagram of the energy recovering circuit shown in FIG. 3.

An operation of the energy recovering circuit shown in FIG. 3 will be described in conjunction with FIG. 4.

The voltage factor of an energy, I.e., a reactive power, is recovered to the capacitor Css through the second switch S2 and the inductor L by the discharge of the panel capacitor Cp charged to a sustaining level.

Figure 5:
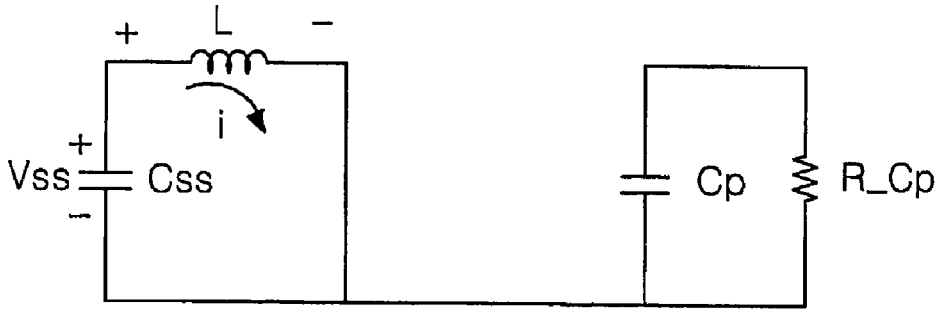
FIG. 5 is an equivalent circuit diagram of the energy recovering circuit shown in FIG. 3 in a preliminary boosting interval.
Figure 6:
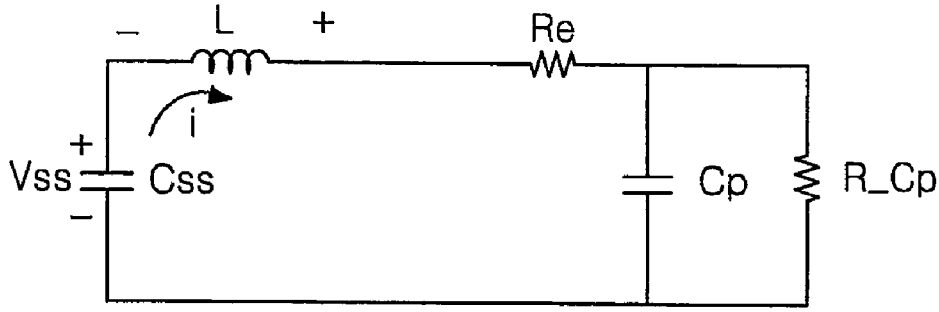
FIG. 6 is an equivalent circuit diagram of the energy recovering circuit shown in FIG. 3 in a panel boosting interval and in a charge interval.
Figure 7:
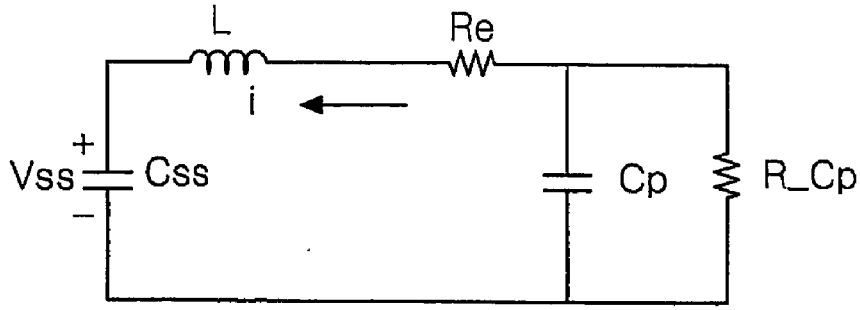
FIG. 7 is an equivalent circuit diagram of the energy recovering circuit shown in FIG. 3 in a time interval of recovering a discharge energy of the panel.

In an interval from t0 until t1, the second switch S2 is turned off while the first switch S1 is turned on, to form a closed loop including the capacitor Css, the inductor L and the first switch S1, as shown in FIG. 5. In this interval, the inductor L charges a current with the aid of an electric charge discharged from the capacitor Css. Accordingly, at this time, the current IL of the inductor L increases, and a voltage across the inductor L is equal to a voltage Vss of the capacitor Css, as can be seen in FIG. 5.

The current charged in the inductor L begins to be fed into the panel capacitor Cp at a time t1 when the first switch S1 is turned off and a body diode of the second switch S2 is turned on. The current IL charged in the inductor L is supplied to the panel capacitor Cp to increase a voltage Vcp of the panel capacitor Cp. At a time t1' when the voltage Vcp of the panel capacitor Cp gets higher than the level of the voltage Vss of the capacitor Css, the current of the inductor L gets its maximum value, and at the same time, the reverse voltage is induced, as in FIG. 6, across the inductor L.

Accordingly, from the time t1' when the reverse voltage is induced in the inductor L, the boosted voltage made by adding the voltage Vss of the capacitor Css and the reverse voltage induced in the inductor L is made to charge the panel capacitor Cp. As a result, the boosted voltage made by adding the voltage charged in the capacitor Css and the reverse voltage induced in the inductor L is made to charge the panel capacitor Cp. In this way, because the boosted voltage that is higher than the voltage recovered from the panel is supplied to the panel, a rising time of a voltage charged in the panel capacitor Cp becomes fast.

Figure 1:
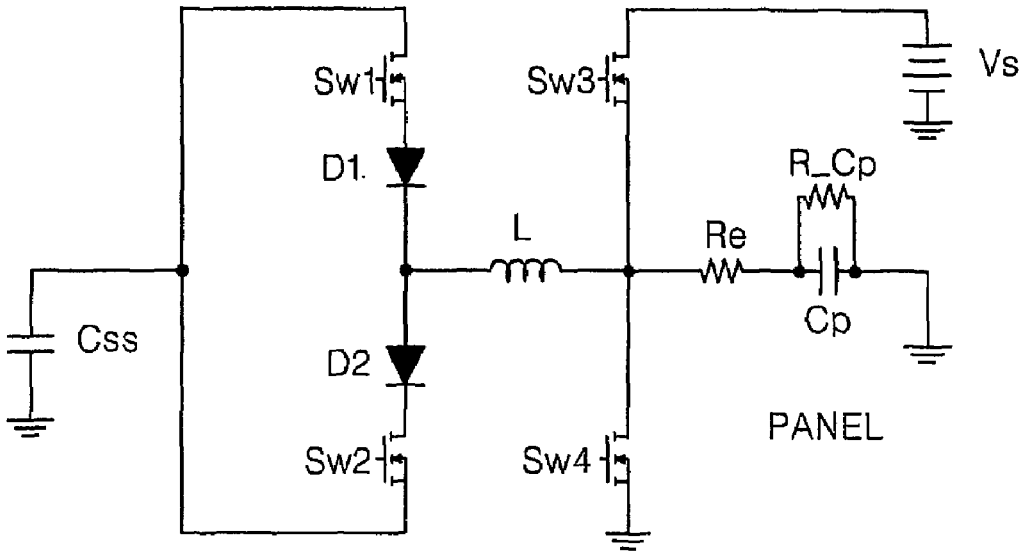
FIG. 1 RELATED ART
FIG. 1 is a circuit diagram of a conventional energy recovering circuit.
Figure 2:
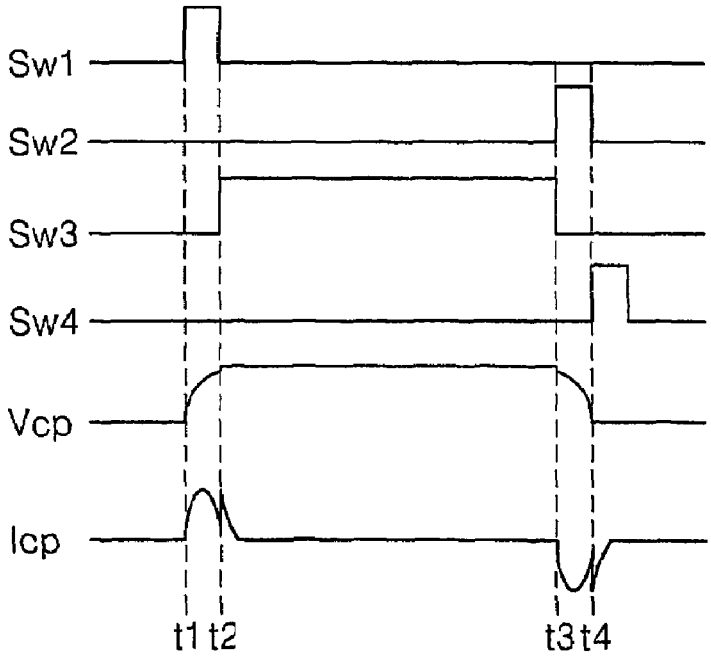
FIG. 2 RELATED ART
FIG. 2 is a driving waveform diagram of the energy recovering circuit shown in FIG. 1.

On the other hand, only the inductor L and the body diode of the second switch S2 exist in a charge current path when charging the panel. When compared to this, a conventional energy recovering circuit, as shown in FIG. 1, has the inductor L, the first switch S1 and the first diode D1 exist in the charge current path upon charging the panel.

At a time t2, the third switch S3 is turned on while the body diode of the second switch S2 is turned off. Then, the sustaining voltage Vs is applied, via the third switch Sw3, to the panel capacitor Cp to keep a voltage level of the panel capacitor Cp at a sustaining voltage level. The electrodes provided within the cell of the panel generates a discharge at this sustaining voltage level.

At a time t3, the third switch S3 is turned off while the second switch S2 is turned on. At this time, the energy recovering circuit shown in FIG. 3 can be expressed as a circuit of FIG. 7. Then, a voltage factor of the energy, i.e., reactive power, that does not contribute to the discharge is recovered from the panel capacitor Cp, via the second switch S2 and the inductor L, to the capacitor Css. only the inductor L and the second switch S2 exist in a current path when recovering the energy. When compared to this, the conventional energy recovering circuit, as shown in FIG. 1, has the inductor L, the second diode and the second switch S2 exist in the current path upon recovering the energy.

A voltage charged in the capacitor Css can be changed by controlling a turn-on time of the second switch S2 from the time t3 until a time t4.

The energy recovering circuit shown in FIG. 3 has only a single semiconductor switching device existing in the charge path and the discharge path thereof, so that it can reduce a conduction loss of the switching device in comparison to the energy recovering circuits shown in FIG. 1. In the energy recovering circuit shown in FIG. 3, the first switch to the third switch S1, S2 and S3 are turned on in a turn-on state of the body diode to switch a zero voltage.

And in the energy recovering circuit shown in FIG. 3, because the phase of the current is delayed by the inductor L, the overlapping portion between the voltage and the current becomes lessened such that there can be minimized a switching loss caused by a phase overlap of a voltage across the first and the second switches S1 and S2 with a current flowing in the first and the second switches S1 and S2.

In the energy recovering circuit shown in FIG. 3, even if the inductance of the inductor L is set to be big for increasing the energy recovery efficiency, the rising time of the boosted voltage supplied to the panel can be made to be fast by controlling the turn-on time of the first switch S1. In other words, in the energy recovering circuit according to the present invention, regardless of the inductance of the inductor L, the rising time of the boosted voltage can be made fast by only controlling the switching time of the first switch S1.

Therefore, it is possible to increase the energy recovery efficiency by increasing the inductance of the inductor L and to make the rising time of the boosted voltage fast.

Figure 8:
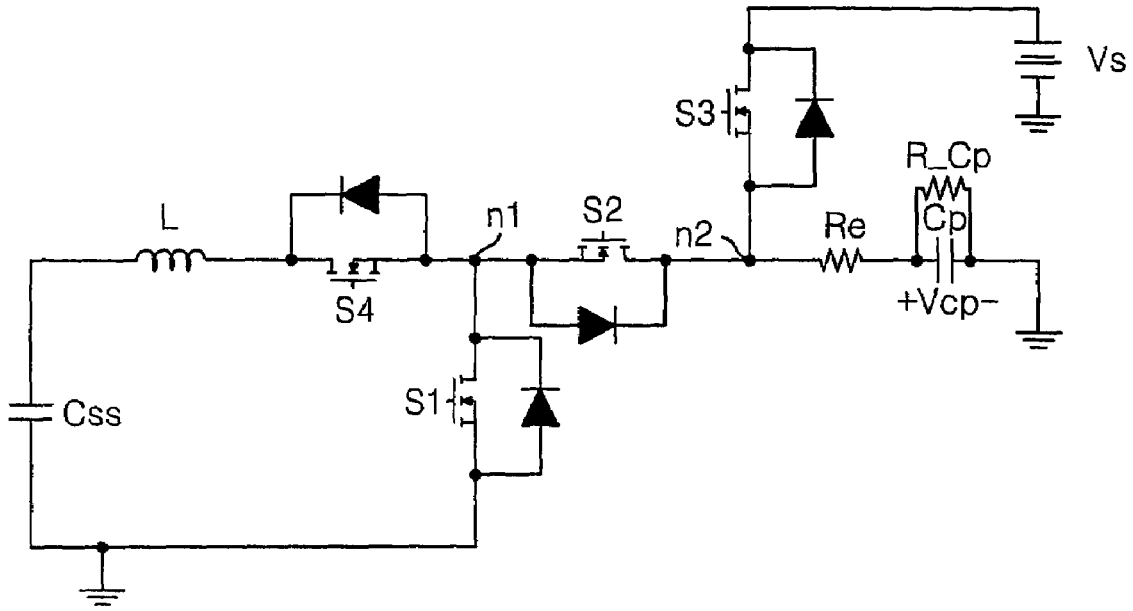
FIG. 8 is a circuit diagram of an energy recovering circuit according to a second embodiment of the present invention.

Referring to FIG. 8, there is shown an energy recovering circuit according to a second embodiment of the present invention.

Referring to FIG. 8, an energy recovering circuit according to a second embodiment of the present invention includes an capacitor Css, an inductor L, a first switch S1 and a fourth switch S4 connected to form a closed loop; a second switch S2 commonly connected, via a first node n1, to the first and the fourth switches S1 and S4 and connected, via a second node n2, to a panel capacitor Cp; and a third switch S3 connected between a second node n2 and a sustaining voltage source vs.

Each of the switches S1, S2 and S3 is implemented by a semiconductor switching device, for example, MOS FET, IGBT, SCR, BJT and etc.

When the first switch S1 and the fourth switch S4 are turned on, there is formed a closed loop of electric current which starts from the terminal of one side of the capacitor Css and is connected to the terminal of another side of the capacitor Css, via the inductor L, the fourth switch S4 and the first switch S1. Electric current is accumulated at the inductor L in the closed loop by the electric charge discharged from the capacitor Css. After the first switch S1 is turned off, the electric current of the inductor L becomes maximized, and at the same time, a reverse voltage is induced across the inductor L. Thus, in a first node n1 appears a boosted voltage that is made by adding the voltage of the capacitor Css and the reverse voltage induced at the inductor L.

The second switch S2 and the fourth switch S4 apply the boosted voltage from the first node n1 to the panel capacitor Cp and apply a voltage factor of an energy recovered from the panel capacitor Cp to the capacitor Css, via the inductor L. The third switch S3 applies a sustaining voltage Vs so as to keep a voltage of the panel capacitor Cp at a sustaining voltage level.

Figure 10A:
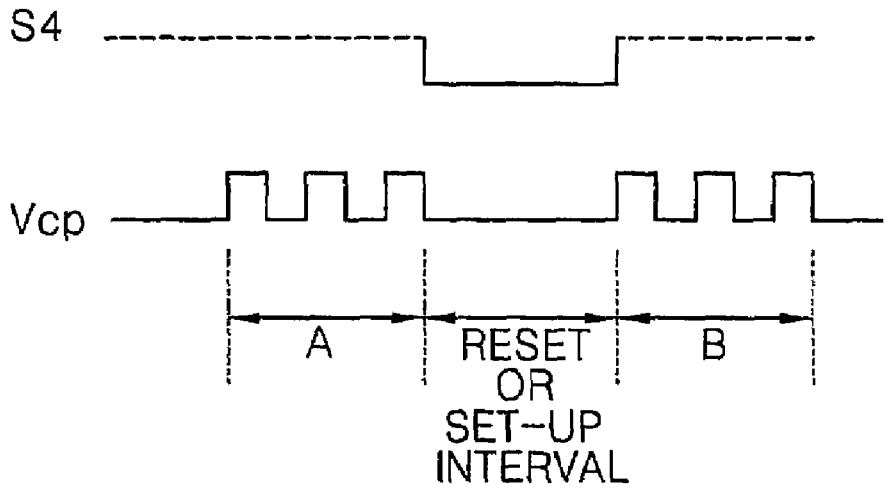
FIGS. 10*a* and 10*b* are waveform diagrams showing an operation of the fourth switch shown in FIG. 8.
Figure 10B:
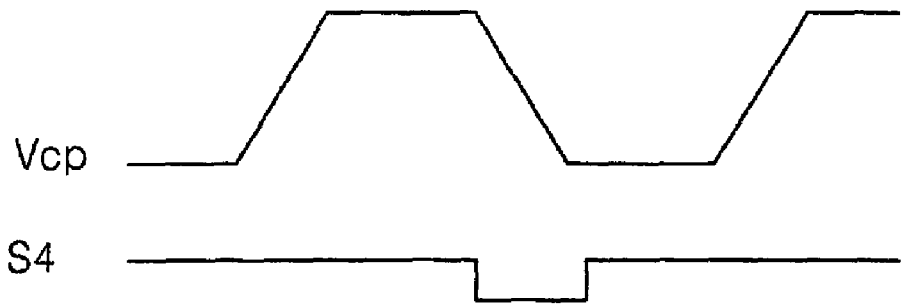

The fourth switch S4 is turned off during pause intervals when the voltage Vcp of the panel capacitor Cp should be kept at the ground voltage level GND, e.g., such as a setup interval between the sustaining interval A and B, a reset interval or an elimination interval, as shown in FIG. 10A, and is turned-on/off repeatedly during the other intervals. Also, the fourth switch S4 is turned off from the time when the voltage Vcp of the panel capacitor Cp starts to fall to the ground voltage level GND till the initial interval while the ground voltage level GND is sustained, as shown in FIG. 10B, and sustains its turn-on state during the other intervals.

Figure 9:
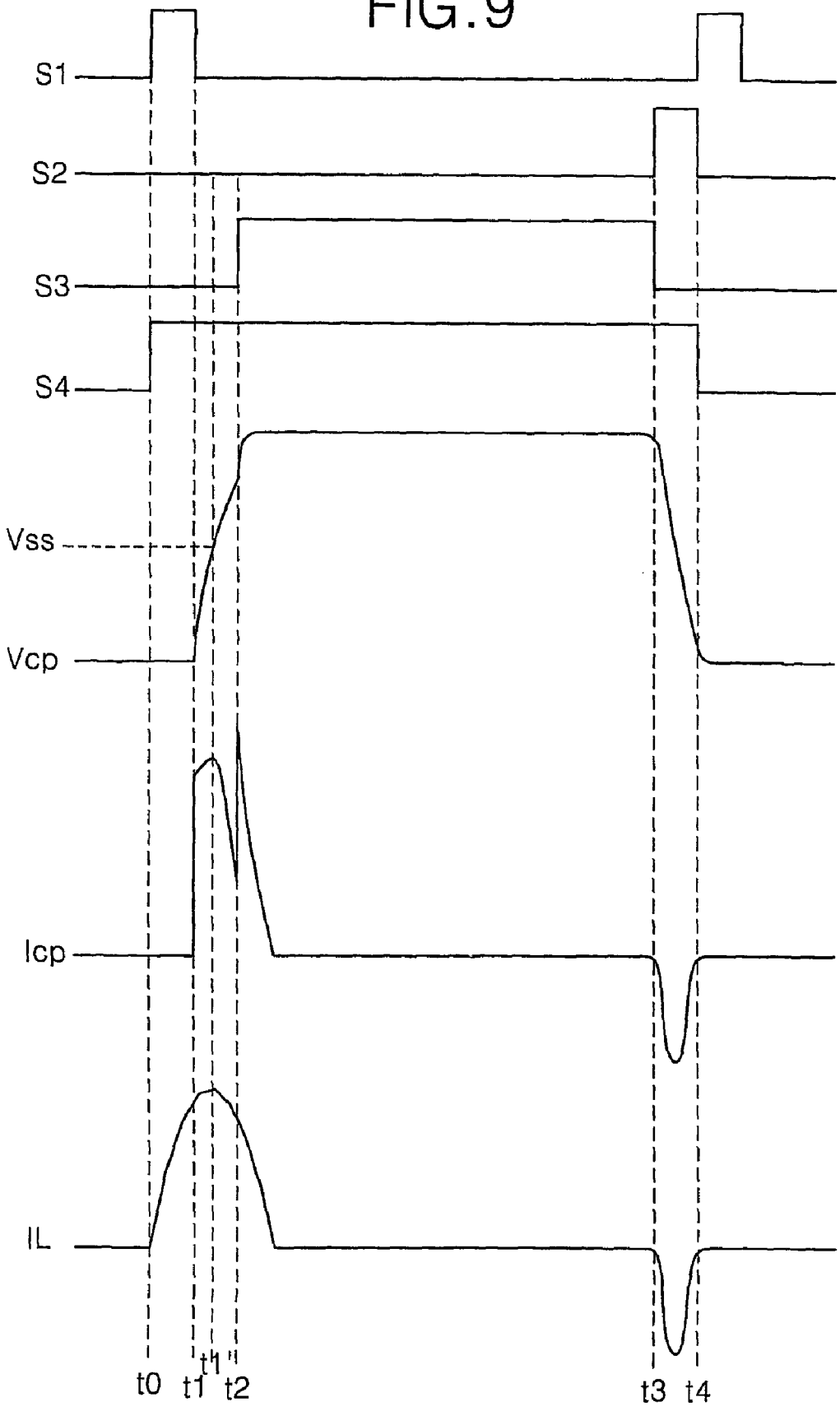
FIG. 9 is a driving waveform diagram of the energy recovering circuit shown in FIG. 8.

The operation of the energy recovering circuit of FIG. 8 is explained in conjunction with FIG. 9, as follows.

The voltage factor of an energy is recovered to the capacitor Css through the second switch S2 and the inductor L by the discharge of the panel capacitor Cp charged to a sustaining level Vs.

In an interval from t0 until t1, the second switch S2 is turned off while the first switch S1 and the fourth switch S4 are turned on, to form a closed loop including the capacitor Css, the inductor L, the first switch S1 and the fourth switch S4. In this interval, the inductor L charges a current with the aid of an electric charge discharged from the capacitor Css.

Accordingly, at this time, the current IL of the inductor L increases.

The current charged in the inductor L begins to be fed into the panel capacitor Cp at a time t1 when the first switch S1 is turned off and a body diode of the second switch S2 is turned on. The current IL charged in the inductor L is supplied to the panel capacitor Cp to increase a voltage Vcp of the panel capacitor Cp. At a time t1' when the voltage Vcp of the panel capacitor Cp gets higher than the level of the voltage Vss of the capacitor Css, the current of the inductor L gets its maximum value, and at the same time, the reverse voltage is induced across the inductor L. Accordingly, from the time t1' when the reverse voltage is induced in the inductor L, the boosted voltage made by adding the voltage Vss of the capacitor Css and the reverse voltage induced in the inductor L is made to charge the panel capacitor Cp.

At a time t2, the third switch S3 is turned on while the body diode of the second switch S2 is turned off. Then, the sustaining voltage Vs is applied, via the third switch Sw3, to the panel capacitor Cp to keep a voltage level of the panel capacitor Cp at a sustaining voltage level.

At a time t3, the third switch S3 is turned off while the second switch S2 is turned on. Then, a voltage factor of the energy recovered from the panel capacitor Cp is stored at the capacitor Css, via the second switch S2, the fourth switch S4 and the inductor L. The inductor L, the second switch S2 and the fourth switch S4 exist in a current path when recovering the energy. The fourth switch S4 is turned off when the panel capacitor Cp remains at the ground voltage level GND after recovering the voltage of the panel capacitor Cp.

Figure 11:
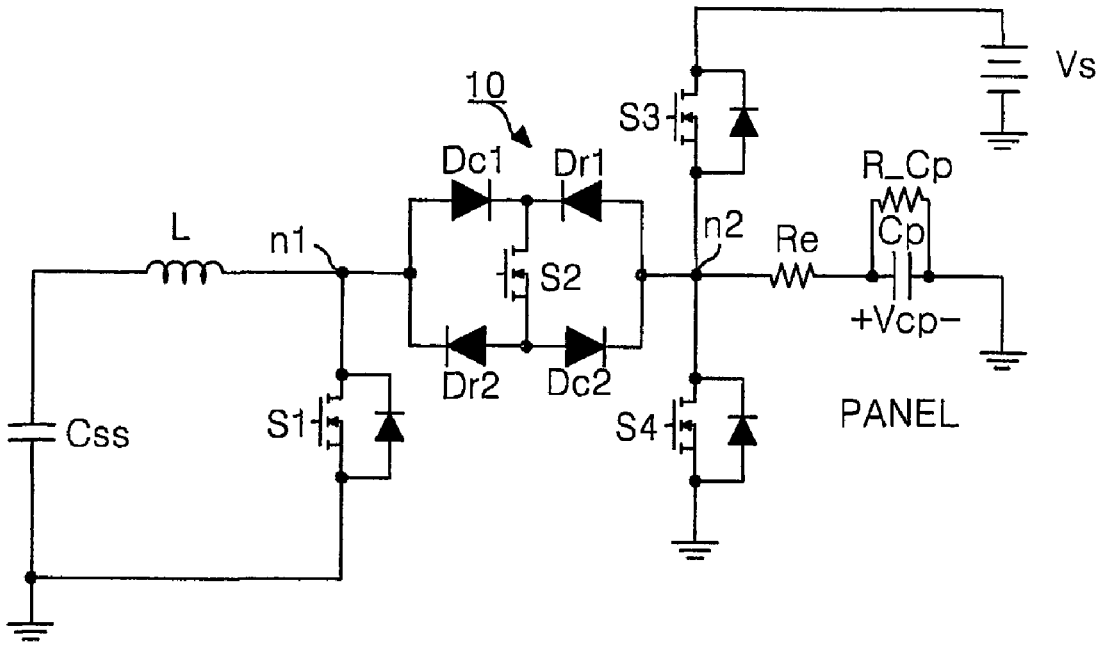
FIG. 11 is a circuit diagram of an energy recovering circuit according to a third embodiment of the present invention.

FIG. 11 shows an energy recovering circuit according to a third embodiment of the present invention.

Referring to FIG. 11, an energy recovering circuit according to a third embodiment of the present invention includes an capacitor Css, an inductor L and a first switch S1 connected to form a closed loop; a bridge circuit 10 commonly connected, via a first node n1, to the inductor L and the first switch S1 and connected, via a second node n2, to a panel capacitor Cp; a third switch S3 connected between a second node n2 and a sustaining voltage source vs; and a fourth switch S4 connected between the second node n2 and a ground voltage source GND.

The bridge circuit 10 consists of diodes Dc1, Dc2, Dr1 and Dr2 connected in a bridge type between the first node n1 and the second node n2, and a second switch S2 connected to the diodes Dc1, Dc2, Dr1 and Dr2. The bridge circuit 10 controls a current path upon the charge/discharge time of the panel.

Each of the switches S1, S2 and S3 is implemented by a semiconductor switching device, for example, MOS FET, IGBT, SCR, BJT and etc.

When the first switch S1 is turned on, there is formed a closed loop of electric current which starts from the terminal of one side of the capacitor Css and is connected to the terminal of another side of the capacitor Css, via the inductor L and the first switch S1. Electric current is accumulated at the inductor L in the closed loop by the electric charge discharged from the capacitor Css. After the first switch S1 is turned off, the electric current of the inductor L becomes maximized, and at the same time, a reverse voltage is induced across the inductor L. Thus, in a first node n1 appears a boosted voltage that is made by adding the voltage of the capacitor Css and the reverse voltage induced at the inductor L.

The second switch S2 is turned on upon the panel discharge to form a panel charge current path by way of the diode Dc1, the second switch S2 and the diode Dc2 so as to apply the boosted voltage from the first node n1 to the panel capacitor Cp. Also, the second switch S2 is turned on upon the energy recovery to form an energy recovery current path by way of the diode Dr1, the second switch S2 and the diode Dr2 so as to apply the voltage factor of the energy recovered from the panel capacitor Cp to the capacitor Css via the inductor L.

The third switch S3 applies a sustaining voltage Vs so as to keep a voltage of the panel capacitor Cp at a sustaining voltage level.

Figure 12:
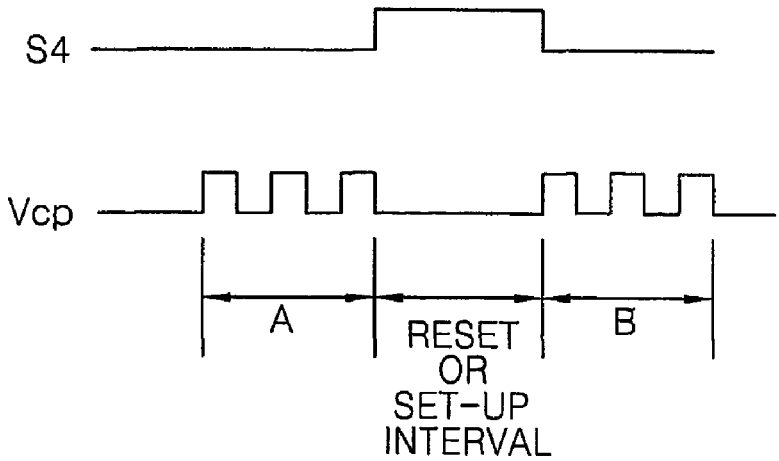
FIG. 12 is a waveform diagram showing an operation of the fourth switch shown in FIG. 11.

The fourth switch S4 is turned on only when the voltage level of the panel capacitor Cp remains at the ground voltage level GND, as shown in FIG. 12 to keep the voltage of the second node n2 at the ground voltage level.

Figure 13:
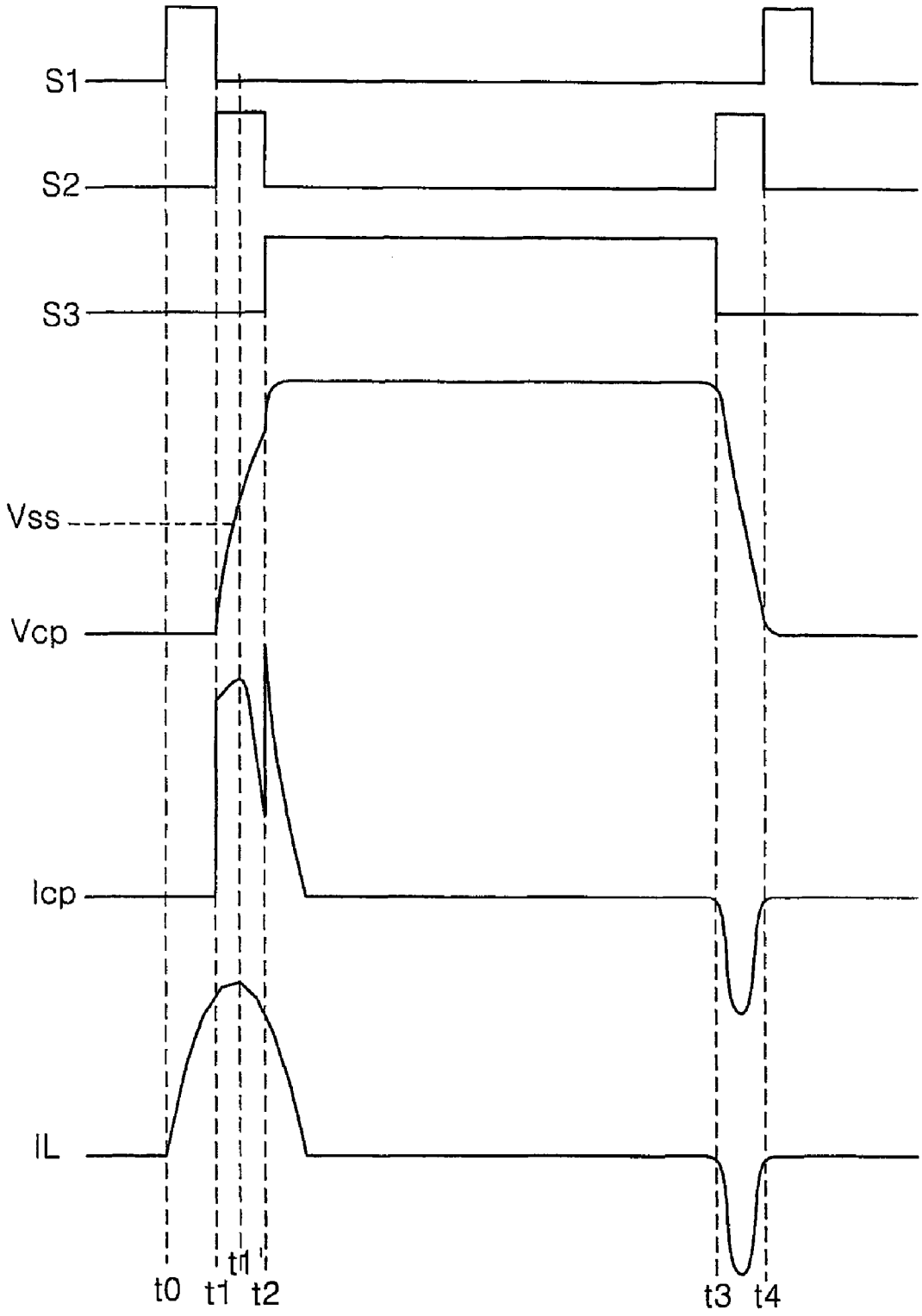
FIG. 13 is a driving waveform diagram of the energy recovering circuit shown in FIG. 11.

The operation of the energy recovering circuit of FIG. 11 is explained in conjunction with FIG. 13, as follows.

The voltage factor of an energy is recovered to the capacitor Css through the second switch S2 and the inductor L by the discharge of the panel capacitor Cp charged to a sustaining level Vs.

In an interval from t0 until t1, the second switch S2 is turned off while the first switch S1 is turned on, to form a closed loop including the capacitor Css, the inductor L and the first switch S1. In this interval, the inductor L charges a current with the aid of an electric charge discharged from the capacitor Css, such that the current IL of the inductor L increases. At this moment, the voltage across the inductor L is equal to the voltage Vss of the capacitor Css.

The current charged in the inductor L begins to be fed into the panel capacitor Cp, via the diode Dc1, the second switch S2 and the diode Dc2, at a time t1 when the first switch S1 is turned off and the second switch S2 is turned on. The current IL charged in the inductor L is supplied to the panel capacitor Cp to increase a voltage Vcp of the panel capacitor Cp. At a time t1' when the voltage Vcp of the panel capacitor Cp gets higher than the level of the voltage Vss of the capacitor Css, the current of the inductor L gets its maximum value, and at the same time, the reverse voltage is induced across the inductor L. Accordingly, from the time t1' when the reverse voltage is induced in the inductor L, the boosted voltage made by adding the voltage Vss of the capacitor Css and the reverse voltage induced in the inductor L is made to charge the panel capacitor Cp.

At a time t2, the third switch S3 is turned on while the second switch S2 is turned off. Then, the sustaining voltage Vs is applied, via the third switch Sw3, to the panel capacitor Cp to keep a voltage level of the panel capacitor Cp at a sustaining voltage level.

At a time t3, the third switch S3 is turned off while the second switch S2 is turned on. Then, a voltage factor of the energy recovered from the panel capacitor Cp is stored at the capacitor Css, via the diode Dr1, the second switch S2, the diode Dr2 and the inductor L. The voltage of the second node n2 remains at the ground voltage level GND because the fourth switch S4 is turned on during the interval when the panel capacitor Cp should remain at the ground voltage level GND after recovering the voltage of the panel capacitor Cp, e.g., the reset interval( setup interval) or a ground voltage sustaining interval between sustaining pulses.

Figure 14:
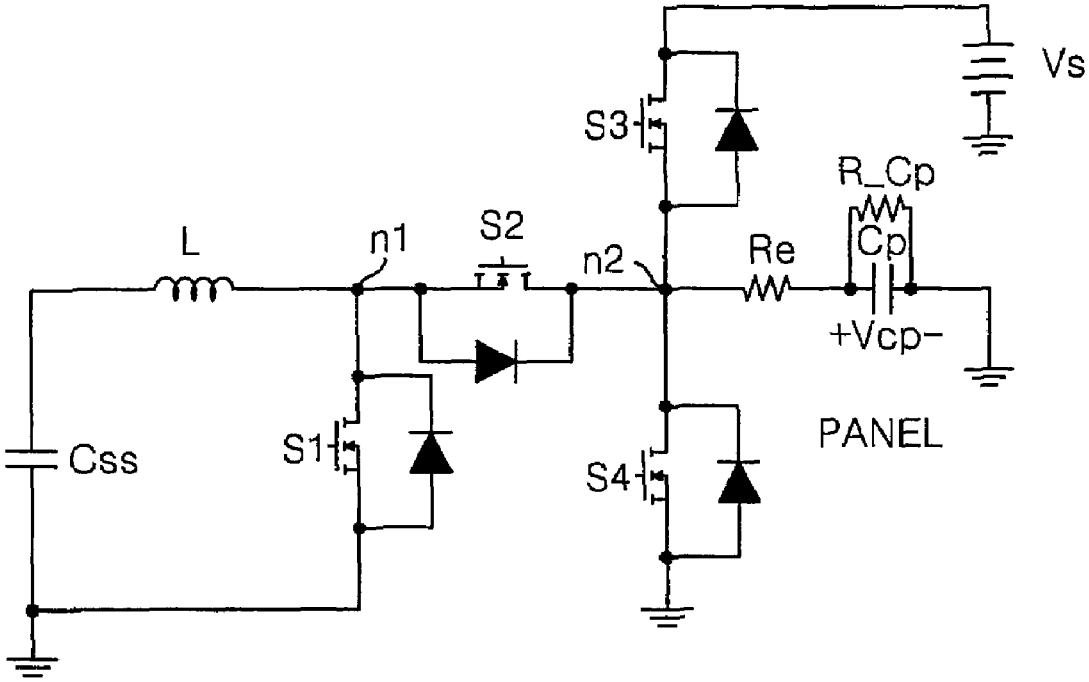
FIG. 14 is a circuit diagram of an energy recovering circuit according to a fourth embodiment of the present invention.
Figure 15:
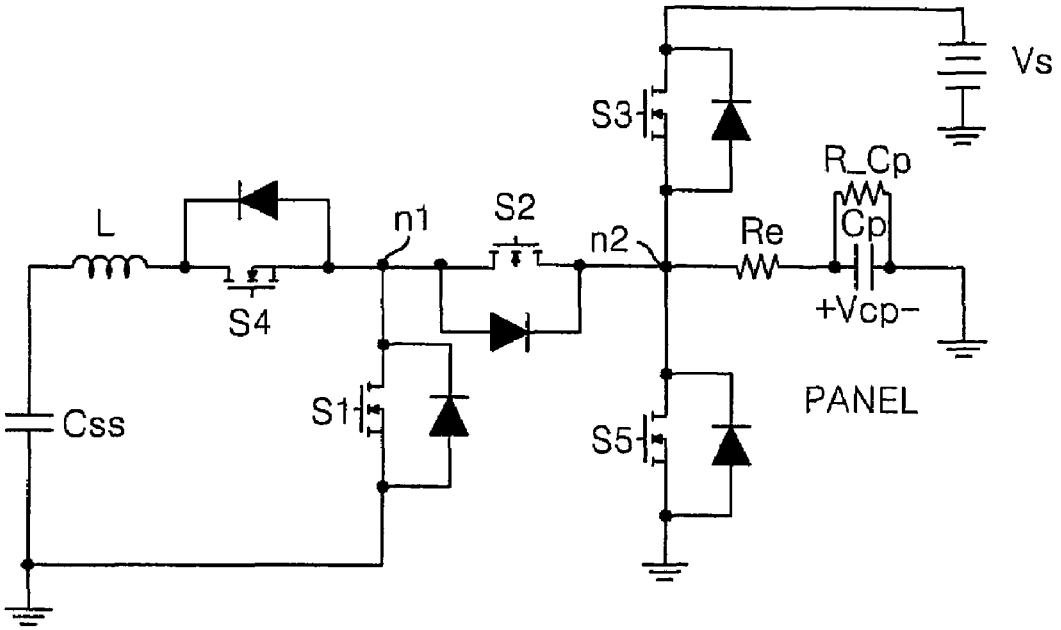
FIG. 15 is a circuit diagram of an energy recovering circuit according to a fifth embodiment of the present invention.
Figure 16:
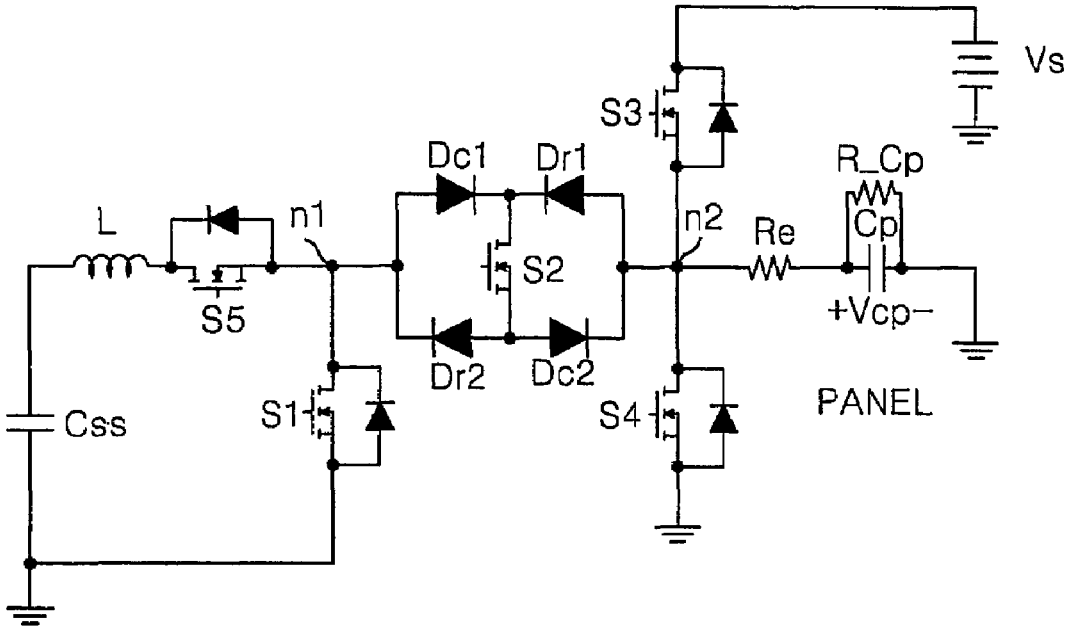
FIG. 16 is a circuit diagram of an energy recovering circuit according to a sixth embodiment of the present invention.

The fourth switch S4 for keeping the panel capacitor Cp at the ground voltage level during the reset interval( setup interval) or a ground voltage sustaining interval between sustaining pulses, can be applicable to the first and the third embodiments of the present invention, as shown in FIGS. 14 to 16.

A fourth switch S4 of FIG. 14, a fifth switch S5 of FIG. 15 and a fourth switch S4 of FIG. 16 are actuated the same as the fourth switch S4 of FIG. 11.

In FIG. 15, the fourth switch S4 connected between the inductor L and the second switch S2 is turned off during the pause intervals such as the setup interval, reset interval or etc. and is turned-on/off repeatedly during the other intervals. Also, the fourth switch S4 is turned off from the time when the voltage Vcp of the panel capacitor Cp starts to fall to the ground voltage level GND till the initial interval while the ground voltage level GND remains and sustains its turn-on state during the other intervals.

Figure 17:
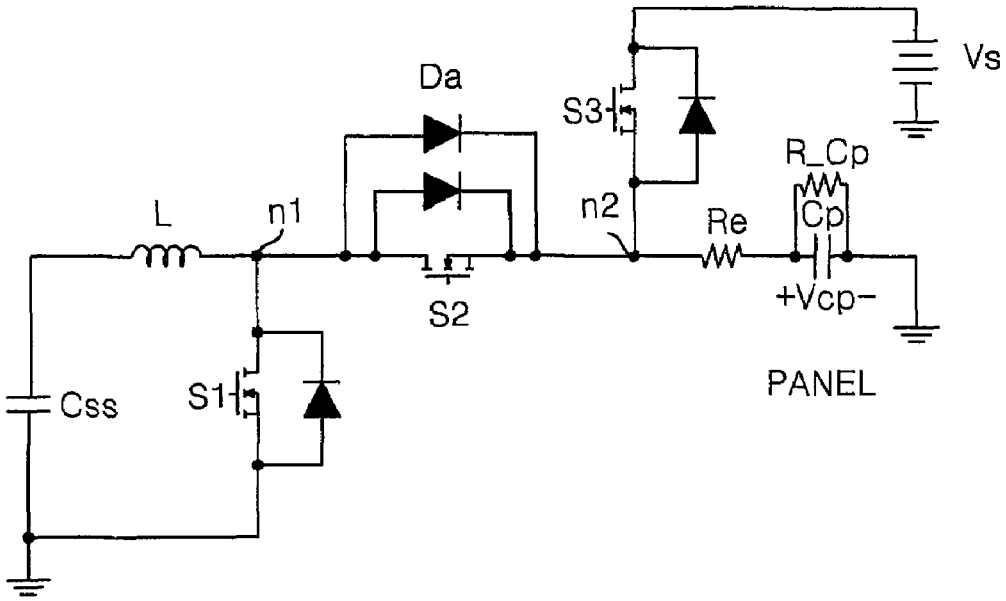
FIG. 17 is a circuit diagram of an energy recovering circuit according to a seventh embodiment of the present invention.

Referring to FIG. 17, an energy recovering circuit according to a seventh embodiment of the present invention includes an capacitor Css, an inductor L and a first switch S1 connected to form a closed loop; a second switch S2 connected, via the inductor L, the first switch and a second node n2, to a panel capacitor Cp; a third switch S3 connected between a second node n2 and a sustaining voltage source vs; and an auxiliary diode Da connected between the first node n1 and the second node n2.

When the first switch S1 is turned on, there is formed a closed loop of electric current which starts from the terminal of one side of the capacitor Css and is connected to the terminal of another side of the capacitor Css, via the inductor L and the first switch S1. Electric current is accumulated at the inductor L in the closed loop by the electric charge discharged from the capacitor Css. After the first switch S1 is turned off, the electric current of the inductor L becomes maximized, and at the same time, a reverse voltage is induced across the inductor L. Thus, in a first node n1 appears a boosted voltage that is made by adding the voltage of the capacitor Css and the reverse voltage induced at the inductor L.

The second switch S2 applys the boosted voltage from the first node n1 to the panel capacitor Cp and applys a voltage factor of an energy recovered from the panel capacitor Cp to the capacitor Css, via the inductor L. The third switch S3 applies a sustaining voltage Vs to the panel capacitor Cp so as to keep a voltage of the panel capacitor Cp at a sustaining voltage level.

The auxiliary diode Da reduces the electric current load rate of the body diode of the second switch S2 and the resistance value of the second switch S2, to reduce the heat-emission of the second switch S2. In other words, the auxiliary diode Da divides the electric current path flowing from th first node n1 to the second node n2 to protect the second switch S2 from the overcurrent and overvoltage.

Figure 18:
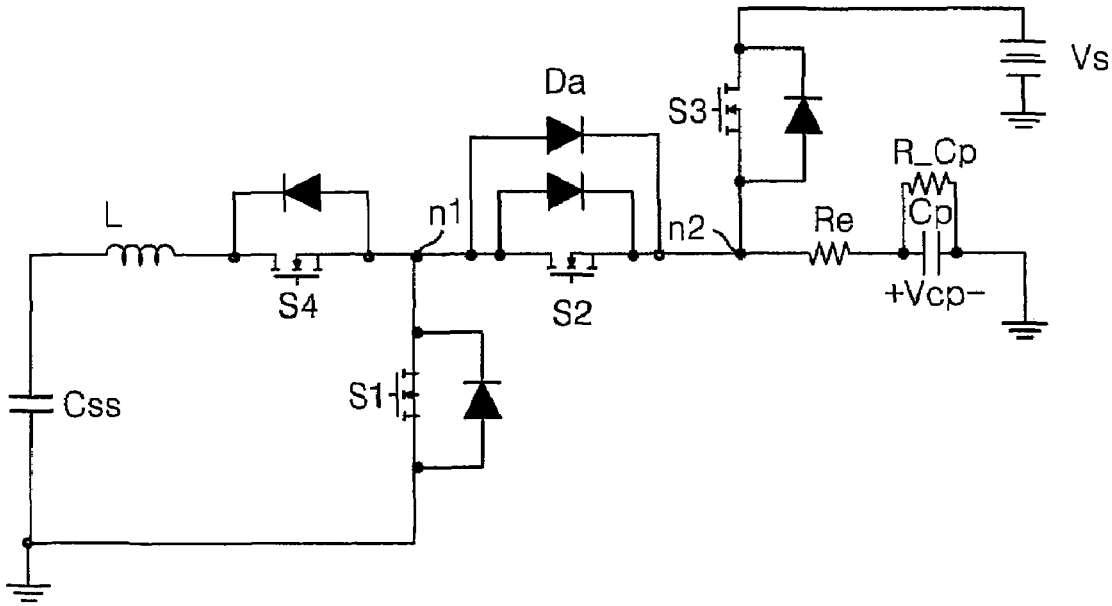
FIG. 18 is a circuit diagram of an energy recovering circuit according to a eighth embodiment of the present invention.
Figure 19:
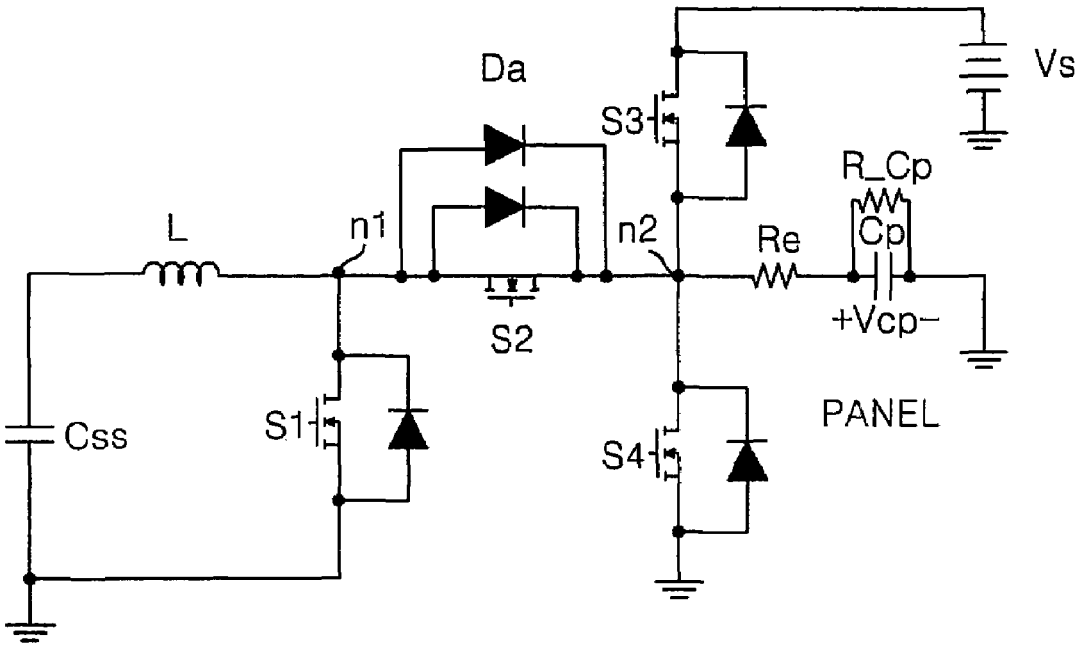
FIG. 19 is a circuit diagram of an energy recovering circuit according to a ninth embodiment of the present invention.
Figure 20:
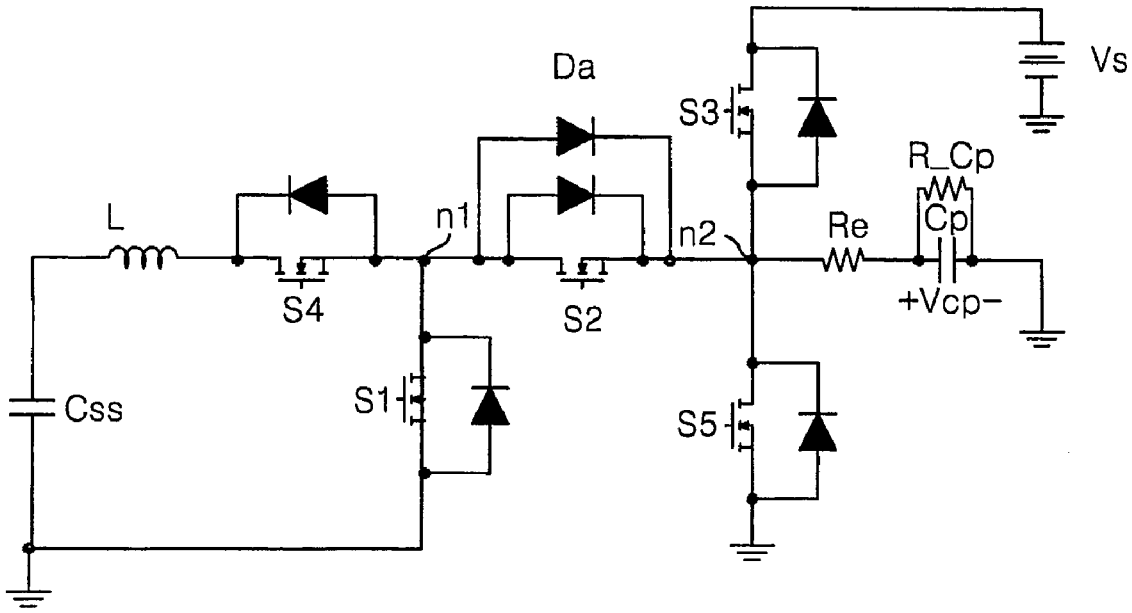
FIG. 20 is a circuit diagram of an energy recovering circuit according to a tenth embodiment of the present invention.

If the auxiliary diode Da is applied to the energy recovering circuits shown in FIGS. 8, 14 and 15, there can be made the energy recovering circuits as shown in FIGS. 18, 19 and 20 respectively.

The operation sequence of the energy recovering circuit where the auxiliary diode Da is mounted, is practically identical to the waveform diagram of FIG. 5.

Figure 21:
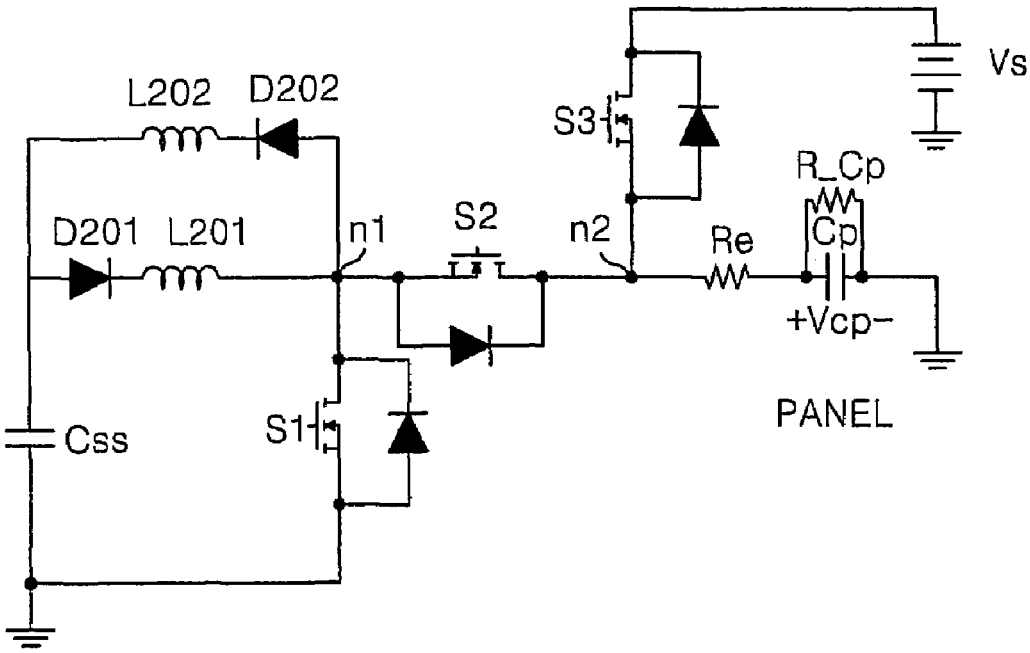
FIG. 21 is a circuit diagram of an energy recovering circuit according to a eleventh embodiment of the present invention.

Referring to FIG. 21, an energy recovering circuit according to an eleventh embodiment of the present invention includes an capacitor Css, a first and a second inductor L201 and L202 and a first switch S1 connected to form a closed loop; a second switch S2 connected, via a second node n2, to a panel capacitor Cp; and a third switch S3 connected between a second node n2 and a sustaining voltage source vs.

A first diode D201 is connected between the first inductor L201 and the capacitor Css, and a second diode D202 is connected between the second inductor L202 and the first node n1. The first diode D201 and the second diode D202 each separates a recovery path via the second inductor L202 and a charge path via the first inductor L201.

When the first switch S1 is turned on, there is formed a closed loop of electric current which starts from the terminal of one side of the capacitor Css and is connected to the terminal of another side of the capacitor Css, via the first inductor L201 and the first switch S1. Electric current is accumulated at the first inductor L201 in the closed loop by the electric charge discharged from the capacitor Css. After the first switch S1 is turned off, the electric current of the first inductor L201 becomes maximized, and at the same time, a reverse voltage is induced across the first inductor L201. Thus, in a first node n1 appears a boosted voltage that is made by adding the voltage of the capacitor Css and the reverse voltage induced at the first inductor L201.

The second switch S2 apply the boosted voltage from the first node n1 to the panel capacitor Cp and apply a voltage factor of an energy recovered from the panel capacitor Cp to the capacitor Css, via the second diode D202 and the second inductor L202. The third switch S3 applies a sustaining voltage Vs to the panel capacitor Cp so as to keep a voltage of the panel capacitor Cp at a sustaining voltage level.

Figure 22:
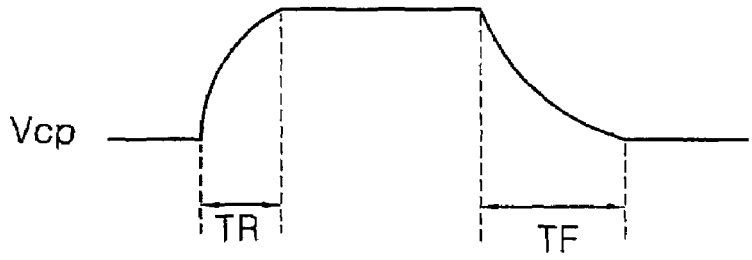
FIG. 22 is a waveform diagram showing a rising time and a falling time of a panel capacitor regulated by the inductance value of a first inductor and a second inductor shown in FIG. 21.
Figure 23:
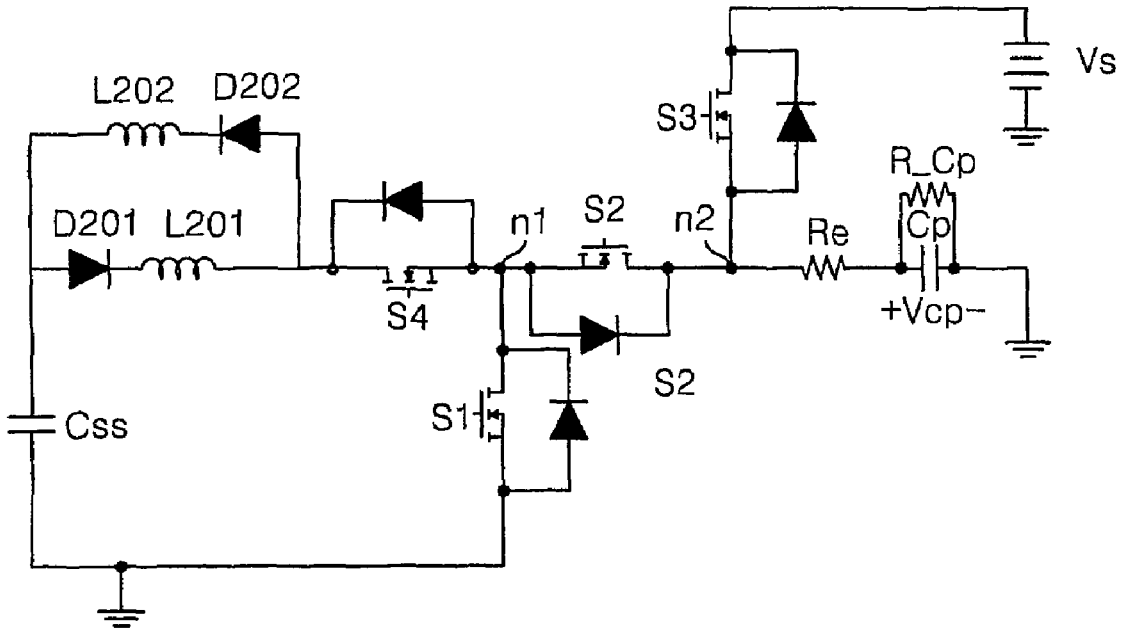
FIG. 23 is a circuit diagram of an energy recovering circuit according to a twelfth embodiment of the present invention.
Figure 24:
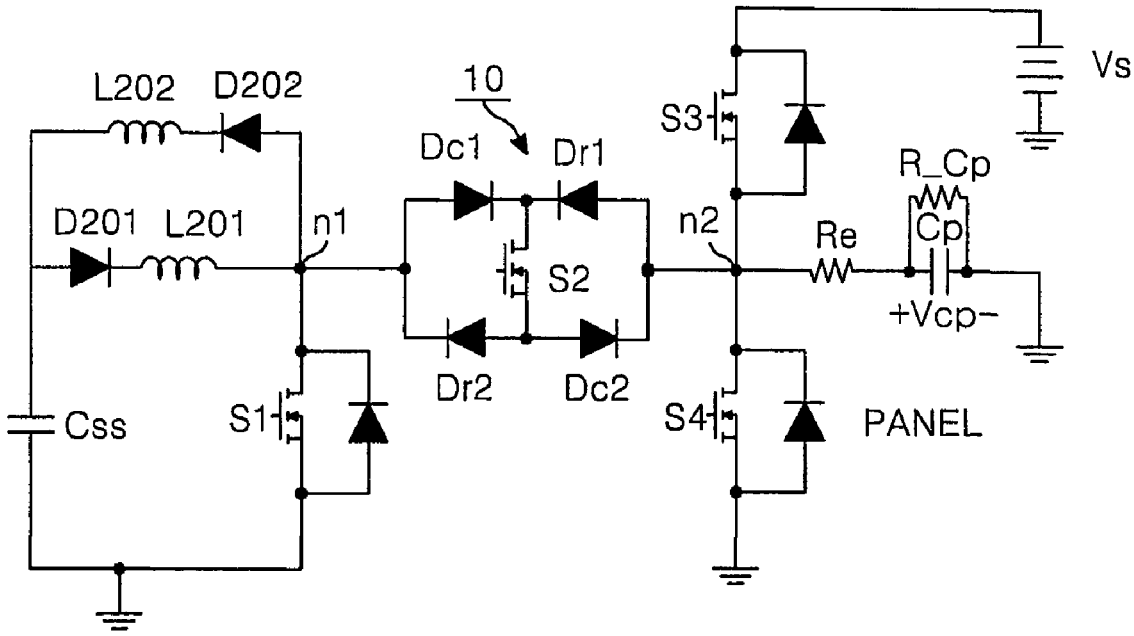
FIG. 24 is a circuit diagram of an energy recovering circuit according to a thirteenth embodiment of the present invention.

The operation of the energy recovering circuit of FIG. 21 is explained in conjunction with FIGS. 4 and 22, as follows.

In an interval from t0 until t1, the second switch S2 is turned off while the first switch S1 is turned on. In this interval, the first inductor L201 charges a current with the aid of an electric charge discharged from the capacitor Css.

The current charged in the first inductor L201 begins to be fed into the panel capacitor Cp through the body diode of the second switch S2 at a time t1 when the first switch S1 is turned off. The current charged in the first inductor L201 is supplied to the panel capacitor Cp to increase a voltage Vcp of the panel capacitor Cp. At a time t1' when the voltage Vcp of the panel capacitor Cp gets higher than the level of the voltage Vss of the capacitor Css, the current of the first inductor L201 gets its maximum value, and at the same time, the reverse voltage is induced across the first inductor L201. Accordingly, from the time t1' when the reverse voltage is induced in the first inductor L201, the boosted voltage made by adding the voltage Vss of the capacitor Css and the reverse voltage induced in the first inductor L201 is made to charge the panel capacitor Cp.

As a result, the boosted voltage made by adding the voltage charged in the capacitor Css and the reverse voltage induced in the first inductor L201 is made to charge the panel capacitor Cp. In this way, because the voltage supplied to the panel capacitor is boosted, a rising time of a voltage charged in the panel capacitor Cp becomes fast.

At a time t2, the third switch S3 is turned on while the body diode of the second switch S2 is turned off. Then, the sustaining voltage Vs is applied, via the third switch Sw3, to the panel capacitor Cp to keep a voltage level of the panel capacitor Cp at a sustaining voltage level. The electrodes provided within the cell of the panel generates a discharge at this sustaining voltage level.

At a time t3, the third switch S3 is turned off while the second switch S2 is turned on. Then, a voltage factor of the energy, i.e., a reactive power, that comes from the panel capacitor Cp but does not contribute to the discharge is stored at the capacitor Css, via the second switch S2 and the second inductor L202.

If a rising time TR when the panel capacitor is charged is shorter, the discharge occurs more stably. Also, if a falling time TF being the recovery interval when the panel capacitor is discharged is longer, the recovery efficiency of the energy recovered to the second inductor L202 and the capacitor Css is increased to decrease the power consumption. For this, the inductance of the second inductor L202 is set to be bigger than that of the first inductor L201. Such a parallel combined inductor can be applicable to the energy recovering circuit shown in the foregoing FIGS. 8 and 11 to be made as in FIGS. 23 and 24 respectively.

Figure 25:
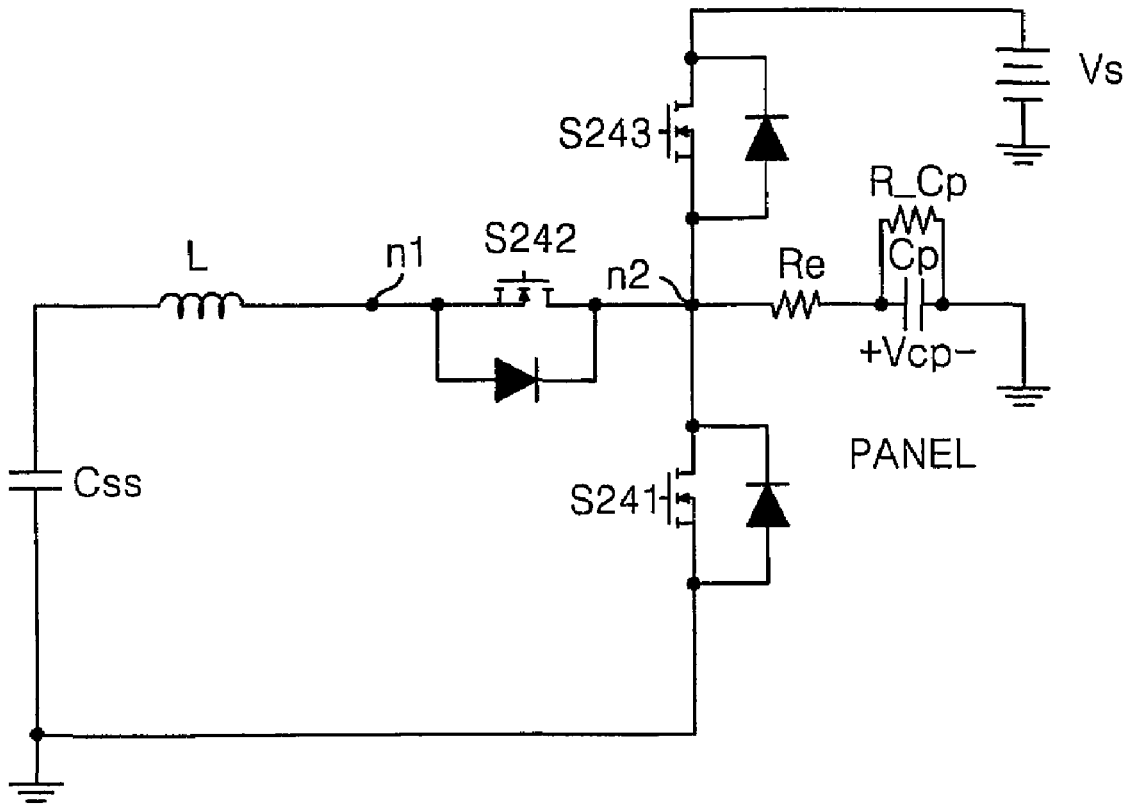
FIG. 25 is a circuit diagram of an energy recovering circuit according to a fourteenth embodiment of the present invention.

Referring to FIG. 25, an energy recovering circuit according to a fourteenth embodiment of the present invention includes an capacitor Css, an inductor L, a first switch S241 and a second switch S242 connected to form a closed loop; and a third switch S3 connected between a second node n2 and a sustaining voltage source vs.

When the first switch S1 is turned on, there is formed a closed loop of electric current which starts from the terminal of one side of the capacitor Css and is connected to the terminal of another side of the capacitor Css, via the inductor L, the first switch S241 and the second switch S242. Electric current is accumulated at the inductor L in the closed loop by the electric charge discharged from the capacitor Css. After the first switch S241 is turned off, the electric current of the inductor L becomes maximized, and at the same time, a reverse voltage is induced across the inductor L. Thus, in a first node n1 appears a boosted voltage that is made by adding the voltage of the capacitor Css and the reverse voltage induced at the inductor L.

The second switch S242 is turned off when the panel is charged, and is turned on in the interval when the capacitor Css and the inductor L are charged. The third switch S3 applies a sustaining voltage Vs to the panel capacitor Cp so as to keep a voltage of the panel capacitor Cp at a sustaining voltage level.

On the other hand, when the voltage Vcp of the panel capacitor Cp remains at the ground voltage level GND, the first switch S241 is turned on during the interval, whereas the second switch S242 is turned off to bypass the voltage on the second node n2 to the ground voltage level GND.

Figure 26:
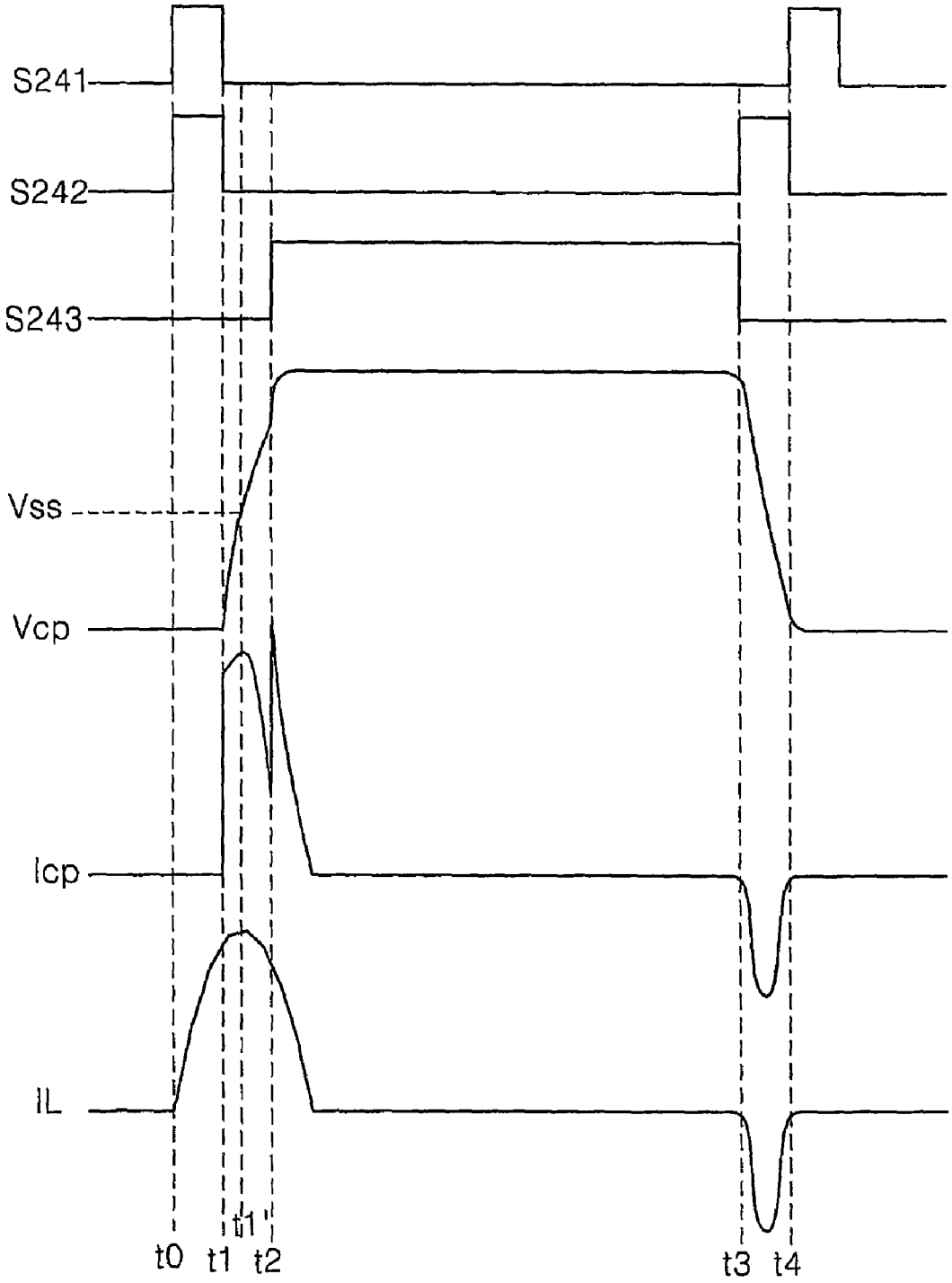
FIG. 26 is a driving waveform diagram of the energy recovering circuit shown in FIG. 25.

The operation of the energy recovering circuit of FIG. 25 is explained in conjunction with FIG. 26, as follows.

At a time t0, the first and the second switch S241 and S242 are simultaneously turned on. Then, in an interval from t0 until t1, the inductor L charges a current with the aid of an electric charge discharged from the capacitor Css.

The current charged in the inductor L begins to be fed into the panel capacitor Cp at a time t1 when the first switch S241 and the second switch S242 is turned off. The current IL charged in the inductor L is supplied to the panel capacitor Cp to increase a voltage Vcp of the panel capacitor Cp. At a time t1' when the voltage Vcp of the panel capacitor Cp gets higher than the level of the voltage Vss of the capacitor Css, the current of the inductor L gets its maximum value, and at the same time, the reverse voltage is induced across the inductor L. Accordingly, from the time t1' when the reverse voltage is induced in the inductor L, the boosted voltage made by adding the voltage Vss of the capacitor Css and the reverse voltage induced in the inductor L is made to charge the panel capacitor Cp.

As a result, the boosted voltage made by adding the voltage charged at the capacitor Css and the reverse voltage induced in the inductor L is supplied to the panel capacitor Cp. In this way, because the voltage is boosted to be supplied to the panel, the rising time of the voltage charged at the panel capacitor Cp gets fast.

At a time t2, the third switch S3 is turned on. Then, the sustaining voltage Vs is applied, via the third switch Sw3, to the panel capacitor Cp to keep a voltage level of the panel capacitor Cp at a sustaining voltage level.

At a time t3, the third switch S3 is turned off while the second switch S242 is turned on. Then, a voltage factor of the energy recovered from the panel capacitor Cp is stored at the capacitor Css, via the second switch S242 and the inductor L, in an interval from t3 until t4.

The inductor L mounted in the energy recovering circuit can be substituted for a parallel combined inductor with inductance values different from one another. Also, this energy recovering circuit can have an auxiliary diode mounted between the first node n1 and the second node n2 as in FIG. 17 to 20.

Figure 27:
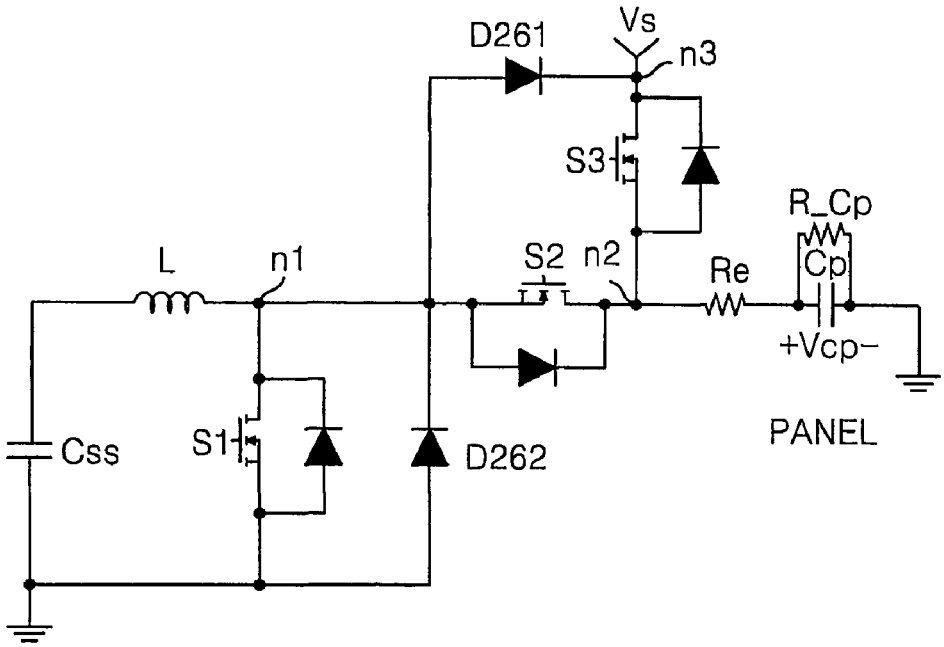
FIG. 27 is a circuit diagram of an energy recovering circuit according to a fifteenth embodiment of the present invention.

Referring to FIG. 27, an energy recovering circuit according to a fourteenth embodiment of the present invention includes an capacitor Css, an inductor L and a first switch S1 connected to form a closed loop; a second switch S2 connected, via a second node n2, to a panel capacitor Cp; a third switch S3 connected between a second node n2 and a sustaining voltage source vs; a first diode D261 connected to a first node n1 and connected to a third node n3 between the sustaining voltage source Vs and the third switch S3; and a second diode D262 connected in parallel to the first switch S1 between a ground voltage source GND and the first node n1.

When the first switch S1 is turned on, there is formed a closed loop of electric current which starts from the terminal of one side of the capacitor Css and is connected to the terminal of another side of the capacitor Css, via the inductor L and the first switch S1. Electric current is accumulated at the inductor L in the closed loop by the electric charge discharged from the capacitor Css. After the first switch S1 is turned off, the electric current of the inductor L becomes maximized, and at the same time, a reverse voltage is induced across the inductor L. Thus, in a first node n1 appears a boosted voltage that is made by adding the voltage of the capacitor Css and the reverse voltage induced at the inductor L.

The second switch S2 applies the boosted voltage from the first node n1 to the panel capacitor Cp and applies a voltage factor of an energy recovered from the panel capacitor Cp to the capacitor Css, via the inductor L. The third switch S3 applies a sustaining voltage Vs to the panel capacitor Cp so as to keep a voltage of the panel capacitor Cp at a sustaining voltage level.

The first diode D261 is turned on when the voltage on the first node n1 rises not less than the sum of the sustaining voltage Vs and the threshold voltage of the first diode D261, such that the overvoltage and overcurrent applied to the first switch S1 are limited. In other words, the first diode D261 protects the first switch S1 from the overvoltage and overcurrent.

The second diode D262 reduces the electric current load rate of the body diode of the first switch S1 and reduces the resistance value of the first switch S1, thereby reducing the heat-emission of the first switch S1.

The first diode D261 and D262 can be applicable to the foregoing embodiments to reduce the electric current load rate applied to each switching device, thereby protecting each switching device from the overvoltage and overcurrent.

Figure 28:
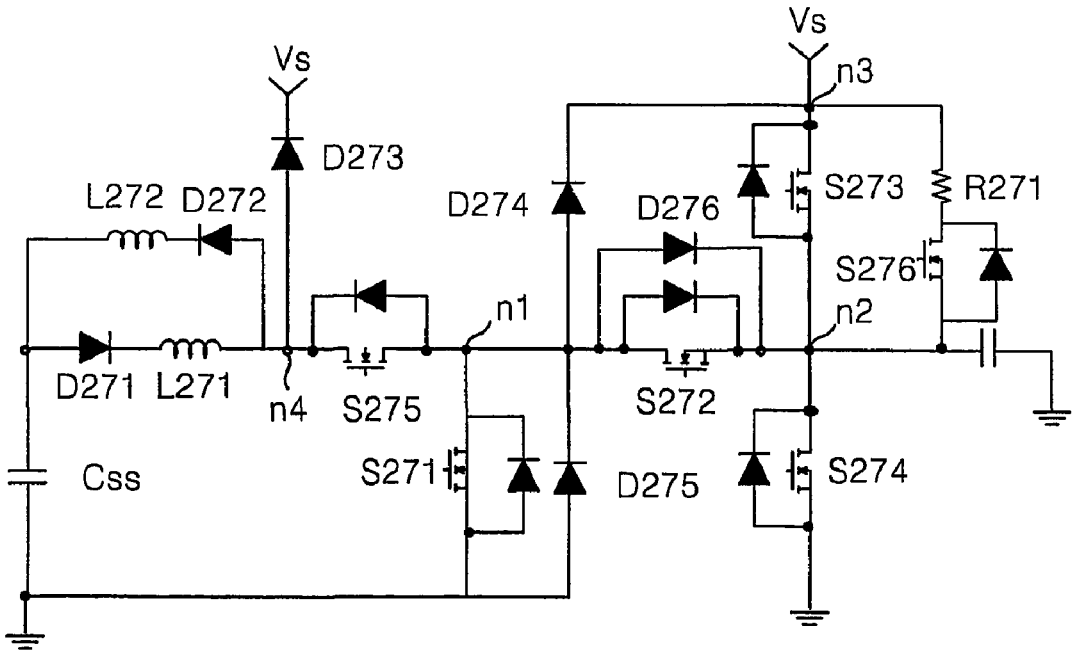
FIG. 28 is a circuit diagram of an energy recovering circuit according to a sixteenth embodiment of the present invention.

Referring to FIG. 28, an energy recovering circuit according to a fifteenth embodiment of the present invention includes an capacitor Css, a first inductor L271, a second inductor L272, a first switch S271 and a fifth switch S275 connected to form a closed loop; a first diode D271 connected between the capacitor Css and the first inductor L271; a second diode D272 connected between the second inductor L272 and a fourth node n4; a second to a fourth and a sixth switches S272, S273, S274 and S276 connected to the panel capacitor Cp via a second node n2; a resistance R271 connected between the sixth switch S276 and a sustaining voltage source Vs; a third diode D273 connected between the fourth node n4 and the sustaining voltage source Vs; a fourth diode D274 connected to a first node n1 and connected a third node between the sustaining voltage source Vs and the third switch S273; a fifth diode D275 connected in parallel to the first switch S271 between a ground voltage source GND and the first node n1; and a sixth diode D276 connected between the first node n1 and the second node n2.

The inductance of the second inductor L272 is set to be bigger than that of the first inductor L271. Each of the first diode D271 and the second diode D272 separates a recovery path via the second inductor L272 and a charge path via the first inductor L271.

When the first switch S1 and the fourth switch S4 are turned on, there is formed a closed loop of electric current which starts from the terminal of one side of the capacitor Css and is connected to the terminal of another side of the capacitor Css, via the first diode D271, the first inductor L271, the fifth switch S275 and the first switch S271. Electric current is accumulated at the first inductor L271 in the closed loop by the electric charge discharged from the capacitor Css. After the first switch S271 is turned off, the electric current of the first inductor L271 becomes maximized, and at the same time, a reverse voltage is induced across the first inductor L271. Thus, in a first node n1 appears a boosted voltage that is made by adding the voltage of the capacitor Css and the reverse voltage induced at the first inductor L271.

The second switch S272 applies the boosted voltage from the first node n1 to the panel capacitor Cp and applies a voltage factor of an energy recovered from the panel capacitor Cp to the capacitor Css, via the body diode of the fifth switch S275, the second diode D272 and the second inductor L202. The third switch S273 applies a sustaining voltage Vs to the panel capacitor Cp so as to keep a voltage of the panel capacitor Cp at a sustaining voltage level.

The fourth switch S274 supplies the ground voltage GND to the panel capacitor Cp for keeping the voltage of the panel capacitor Cp at a sustaining voltage leve.

The fifth switch S275 is turned off during pause intervals when the voltage Vcp of the panel capacitor Cp should be kept at the ground voltage level GND, e.g., such as a setup interval, a reset interval or etc., and is turned-on/off repeatedly during the other intervals to provide with an electric current path upon the recovery and charge of the energy.

The sixth switch S276 is turned on in the reset interval or the setup interval to supply a ramp voltage to the panel capacitor Cp. The first resistance R271 determines the resistance value of RC time constant of the ramp voltage.

The third diode D273 is turned on when the voltage on the fourth node n4 rises not less than the sum of the sustaining voltage Vs and the threshold voltage of the third diode D273, to limit the overvoltage and overcurrent applied to the fifth switch S275.

The fourth diode D274 is turned on when the voltage on the first node n1 rises not less than the sum of the sustaining voltage Vs and the threshold voltage of the fourth diode D274, to limit the overvoltage and overcurrent applied to the first, the second and the fifth switches S271, S272 and S275.

The fifth diode D275 reduces the electric current load rate of the body diode of the first switch S271 and the resistance value of the first switch S271, thereby reducing the heat-emission of the first switch S271.

Figure 29:
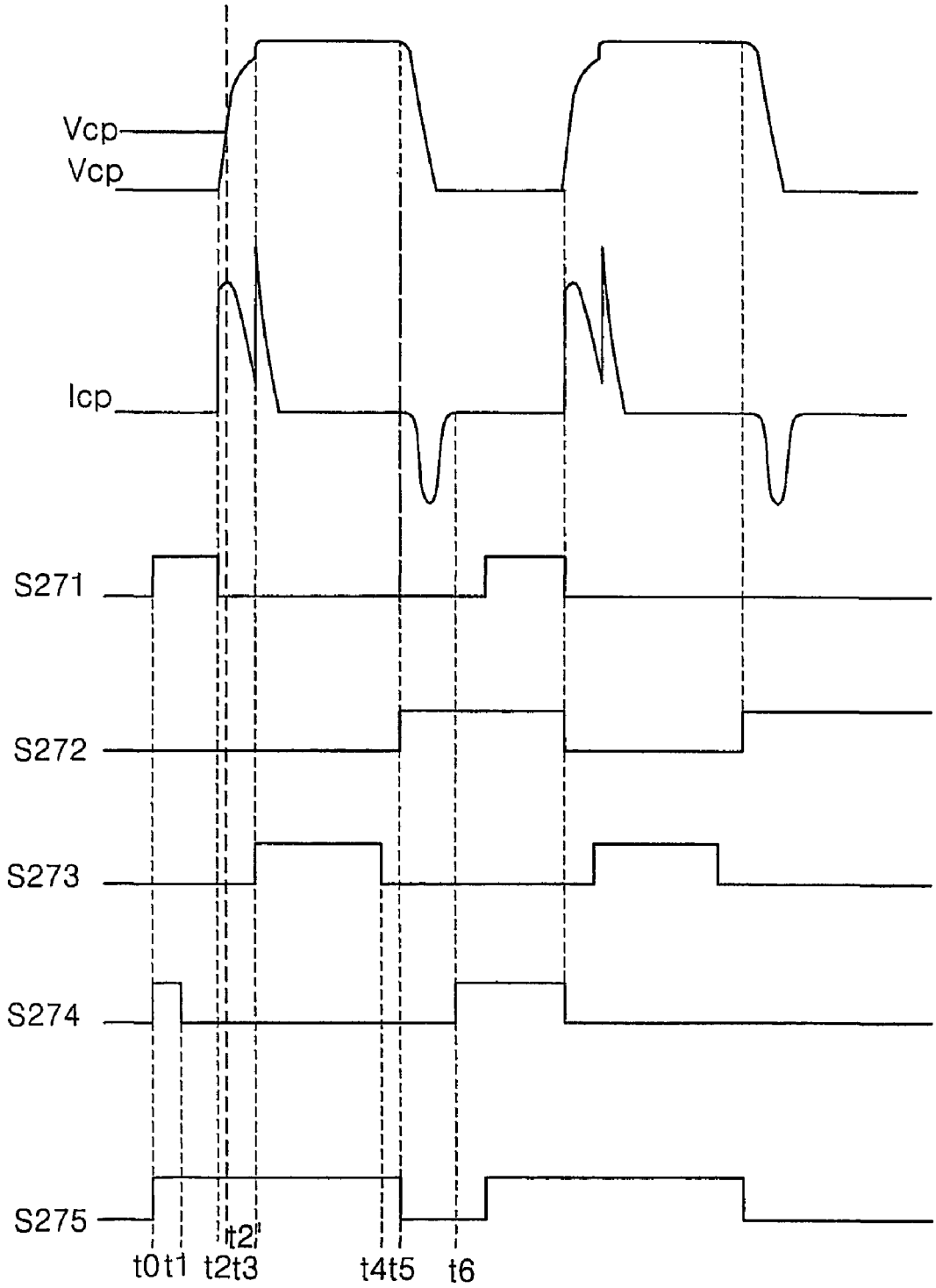
FIG. 29 is a driving waveform diagram of the energy recovering circuit shown in FIG. 28.

The operation of the energy recovering circuit of FIG. 28 is explained in conjunction with FIG. 29, as follows. In FIG. 29, because the sixth switch S276 remains at the turn-on state only in the reset interval or setup interval, there is omitted the operation waveform in regard to the sixth switch S276.

At a time t0, the first, the fourth and the fifth switchs S271, S274 and S275 are turned on. Subsequently, at a time t1 and a time t2, the fourth switch S274 and the first switch S271 are sequentially turned off. At a time t2' between the time t2 and a time t3, the current of the first inductor L271 gets its maximum value, and at the same time, the reverse voltage is induced across the first inductor L271. the boosted voltage made by adding the voltage Vss of the capacitor Css and the reverse voltage induced in the first inductor L271 in this way starts to be fed to the panel capacitor Cp.

At a time t3, the third switch S273 is turned on. Then, the sustaining voltage Vs is applied, via the third switch S273, to the panel capacitor Cp to keep a voltage level of the panel capacitor Cp at a sustaining voltage level. There occurs a discharge at the electrodes formed within the cell of the panel at this sustaining voltage level.

At a time t4, the third switch S273 is turned off, and at a time t5, the second switch S272 is turned on and the fifth switch S275 is turned off. Then, a voltage factor of the energy, i.e, reactive power, that does not contribute to the discharge occurring from the panel capacitor Cp is recovered to the capacitor Css, via the second switch S272, the body diode of the fifth switch S275, the second diode D272 and the second inductor L272.

At a time t6, the fourth switch S274 is turned on. Then, the panel capacitor Cp remains at the ground voltage GND.

Figure 30:
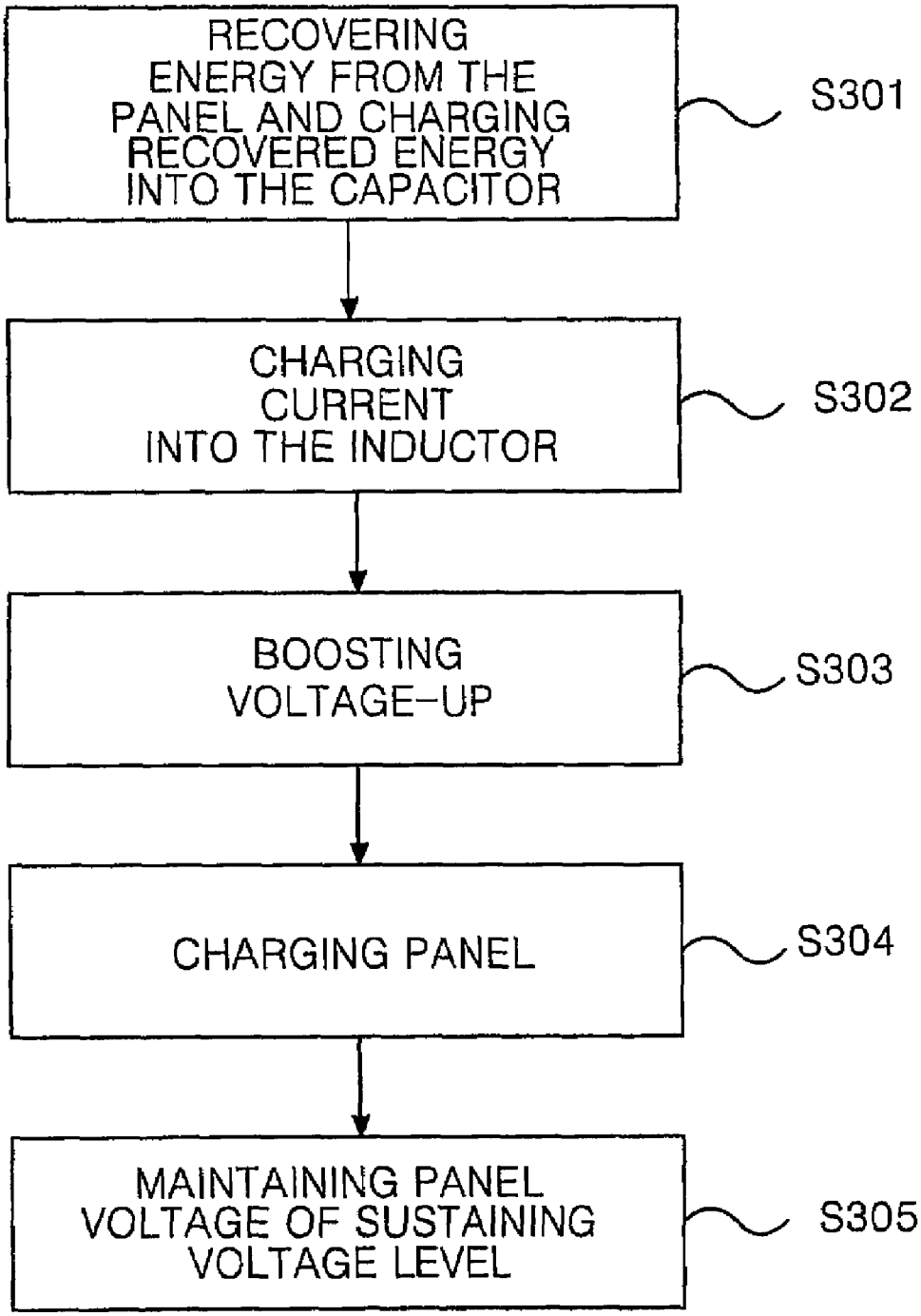
FIG. 30 a flow chart showing by steps an operation process of an energy efficient method using an energy recovering circuit with boosting voltage-up according to the embodiments of the present invention.

The operation process of an energy efficient method using an energy recovering circuit with boosting voltage-up according to the embodiments of the present inventions is illustrated by steps as in FIG. 30.

First of all, when the energy, i.e., reactive power, that does not contribute to the discharge from the display panel, is recovered, the capacitor Css is charged with the voltage by using the recovered reactive power. (S301) The electric charges discharged from the capacitor Css circulates the closed loop, such that the inductor L is charged with the current. (S302) Subsequently, when the current of the inductor L becomes its maximum value by the switching of the current path, the reverse voltage is induced in the inductor L and is added with the voltage of the capacitor Cp to boost the voltage factor of the energy recovered from the panel. (S303) The voltage boosted in this way charges the panel capacitor Cp. (S304) After the voltage of the panel capacitor Cp rises near to the sustaining voltage level, the panel capacitor Cp remains at the sustaining voltage level by the sustaining voltage Vs supplied from the external sustaining voltage source.(305)

As described above, an energy recovering circuit with boosting voltage-up and an energy efficient method using the same according to the present invention can increase the energy recovery efficiency, and reduce the charging time of a panel capacitor and improve its energy recovery efficiency in comparison with the conventional energy recovering circuit by charging the panel capacitor in use of the voltage boosted not less than the recovered voltage.

An energy recovering circuit with boosting voltage-up and an energy efficient method using the same according to the present invention has the minimum number of devices mounted on the recovery path and charge path of the panel to reduce the number of necessary devices, and can reduce the switching loss energy as much as the decrement of the switching devices in comparison with the conventional energy recovering circuit.

It should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

The invention claimed is:

1. A method of driving a display panel having panel electrodes and corresponding panel capacitance, comprising:

(a) charging the panel capacitance using an inductor, wherein (i) initially prior to charging the panel capacitance, increasing an energy in the inductor until a magnitude of an inductor current reaches a first prescribed level which is less than a maximum, and (ii) while charging the panel capacitance, obtaining a maximum current of the inductor and thereafter removing the stored energy from the inductor until the inductor current reaches a second prescribed level which is greater than zero; and (b) discharging the panel capacitance by recovering a reactive energy of the panel capacitance using the inductor, wherein during step (a)(ii) and prior to step (b), clamping a voltage level of the panel capacitance upon the inductor current reaching the second prescribed level, which is greater than zero.

2. The method of claim 1, wherein the step (a)(i) includes oscillation of the energy between the inductor and a capacitor, which form an L-C circuit, such that the magnitude of the inductor current reaches the first prescribed level which is less than the maximum prior to charging the panel capacitance.

3. The method of claim 2, wherein the step (a)(ii) includes transfer of energy of the inductor and the capacitor to the panel capacitance.

4. The method of claim 2, wherein step (b) comprises recovering the reactive energy of the panel capacitance to the capacitor.

5. The method of claim 4 further comprises clamping the voltage level of the panel capacitance upon recovering the reactive energy.

6. The method of claim 1, wherein the first prescribed level of the inductor current is greater than the second prescribed level, both being greater than zero.

7. The method of claim 1, wherein prior to clamping, the voltage level of the panel capacitance reaches a first prescribed voltage level.

8. The method of claim 7, wherein the voltage level of the panel capacitance is clamped to a sustain voltage level, which is greater than the first prescribed voltage level.

9. A driving circuit for driving a panel having panel electrodes and panel capacitance, comprising:

a capacitor and an inductor serially coupled to the panel electrodes for charging and discharging the panel capacitance;

first switch means having first and second nodes, the first node being coupled to the inductor and the second node being not coupled to panel electrodes, wherein the first switch means allows oscillation of energy between the capacitor and the inductor such that prior to charging the panel capacitance, a magnitude of an inductor current reaches a first prescribed current level which is less than a maximum;

second switch means coupled to said inductor to enable said panel capacitance to charge and discharge through the inductor, wherein (i) the panel capacitance charges from a first voltage level to a prescribed voltage magnitude after the first prescribed current level of the inductor current has been reached and (ii) the panel capacitance discharges from a sustain voltage magnitude to a second voltage level by recovering a reactive energy of the panel capacitance using the inductor and the capacitor; and third switch means coupled to the second switch means that clamps a panel capacitance voltage to the sustain voltage magnitude prior to the inductor current reaching zero.

10. The driving circuit of claim 9 further comprising fourth switch means coupled to the second switch means for clamping the panel capacitance voltage level to maintain the panel capacitance in a discharged state until the panel capacitance is recharged.

11. The driving circuit of claim 9, wherein an amount of the reactive energy recovered is based on a turn-on time of the second switch means.

12. The driving circuit of claim 9, wherein a rising time period from the first voltage level to the prescribed voltage magnitude is based on a turn-on time of the first switch means and independent of an inductance of the inductor.

13. The drawing circuit of claim 9, wherein the prescribed voltage magnitude is less than the sustain voltage magnitude.

14. The driving circuit of claim 9, wherein the panel capacitance voltage is clamped to a sustain voltage magnitude when the inductor current reaches a second prescribed current level, which is greater than zero and less than the first prescribed current level.

15. A driving circuit coupled to display electrodes of a display device comprising:

a capacitor having first and second nodes;

an inductor having first and second nodes, the first node of the inductor being coupled to the second node of the capacitor;

a first switch having first and second nodes, the first node of the first switch being coupled to the second node of the inductor;

a second switch having first and second nodes, the first node of the second switch being coupled to the first node of the first switch, and the second node of the second switch for coupling to the display electrodes; and a third switch having a first node for coupling to the second node of the second switch, and having a second node for coupling to a prescribed potential, wherein the display device is a plasma display panel and the display electrodes are panel electrodes having a corresponding panel capacitance, wherein the second switch allows (1) transfer of energy from the capacitor and the inductor to the panel capacitance during charging and (2) transfer of energy from the panel capacitance to the capacitor through the inductor during discharging, and wherein prior to transfer of energy, the first switch allows an inductor current to reach a first prescribed current value which is great than zero, and during the transfer of energy, the second switch allows a voltage of the panel capacitance to reach a prescribed voltage, and the third switch clamps the panel capacitance to the prescribed potential prior to the inductor current reaching zero.

16. The driving circuit of claim 15, wherein each of the first, second and third switches comprises a transistor and a diode coupled in parallel.

17. The driving circuit of claim 16, wherein the diode is a body diode of the transistor.

18. The driving circuit of claim 15, wherein the first switch allows oscillation of energy between the capacitor and the inductor prior to transfer of the energy to the display electrodes through the second switch.

19. A display device incorporating the driving circuit of claim 15, wherein the display device is a plasma display panel.

20. The driving circuit of claim 15, wherein energy is oscillated between the inductor and the capacitor by forming a closed loop via the first switch prior to charging the panel capacitance through the second switch.

21. The driving circuit of claim 15, wherein an amount of energy transfer from the panel capacitance to the capacitor is based on a turn-on time of the second switch.

22. The driving circuit of claim 15, wherein the panel capacitance is clamped to the prescribed potential when the inductor current reaches a second prescribed current value which is greater than zero and less than the first prescribed current.

23. The driving circuit of claim 15, wherein the prescribed potential is greater than the prescribed voltage.

* * * * *